US005991975A

United States Patent [19]

Baer

[11] Patent Number: 5,991,975

[45] Date of Patent: Nov. 30, 1999

[54] COVERED PINNED HINGE

[76] Inventor: Austin R. Baer, 244416 Highway 550, Ridgway, Colo. 81432

[21] Appl. No.: 08/964,638

[22] Filed: Nov. 5, 1997

[51] Int. Cl.[6] ..... E05D 7/00

[52] U.S. Cl. ..... 16/354; 16/250

[58] Field of Search ..... 16/250, 277, 354

[56] References Cited

U.S. PATENT DOCUMENTS

| | | | |
|---|---|---|---|
| 591,359 | 10/1897 | Pomeroy | 16/277 |
| 1,552,916 | 9/1925 | Farrington | 16/277 |
| 2,342,453 | 2/1944 | Colucci | 16/250 |
| 3,121,946 | 2/1964 | Young | 16/277 |
| 3,128,898 | 4/1964 | Burman, Jr. | 16/277 |
| 3,374,499 | 3/1968 | Horstman | 16/354 |
| 3,499,183 | 3/1970 | Parsons . | |
| 3,787,923 | 1/1974 | Peterson . | |
| 3,921,225 | 11/1975 | Suska . | |
| 3,999,246 | 12/1976 | Suska . | |
| 4,097,959 | 7/1978 | Johnson . | |
| 4,284,861 | 8/1981 | Senften | 200/61.7 |
| 4,419,788 | 12/1983 | Prout | 16/300 |
| 4,583,262 | 4/1986 | Werner | 16/300 |
| 4,679,277 | 7/1987 | Shibata | 16/354 |
| 4,761,853 | 8/1988 | Hoffman | 16/354 |
| 4,976,008 | 12/1990 | Baer | 16/354 |
| 4,999,879 | 3/1991 | Baer | 16/354 |
| 4,999,880 | 3/1991 | Baer | 16/354 |
| 5,001,810 | 3/1991 | Baer | 16/354 |
| 5,201,902 | 4/1993 | Baer | 16/354 |

FOREIGN PATENT DOCUMENTS

| | | | |
|---|---|---|---|
| 1448729 | 8/1966 | France . | |
| 24 57 413 | 6/1975 | Germany | 16/354 |

OTHER PUBLICATIONS

Roton Continous Hinge Brochure, 1989, Roton Corporation.

Hager General Information, p. IX w/metalworking operations and equipment definitions.

Hager Hardware Brochure, 08710/HAG Buyline 3643, Hager Hinge Company, St. Louis, MO 63104.

*Primary Examiner*—Chuck Y. Mah
*Assistant Examiner*—Donald M. Gurley
*Attorney, Agent, or Firm*—Pennie & Edmonds LLP

[57] ABSTRACT

A pinned hinge comprising with first and second hinged members respectively including first and second leaves. The leaves have knuckles that define first bores that extend through the knuckles in a longitudinal direction. A pin is received within the bores of both leaves, pivotably joining the leaves. A cover, defining a longitudinal channel, surrounds the knuckles, protecting them. The leaves are operatively connected to the cover such that pivotal movement of the leaves displaces the cover with respect to the pin. Shanks connecting the knuckles to leaf bodies preferably have at least a double bend to retard interference between the cover and the leaves during pivoting. In one embodiment, the knuckles have gear sectors meshed with racks in the cover. In another embodiment, leaf springs operatively connect the cover to the leaves. Further embodiments include a seal disposed for sealing the cover to the hinged members when the hinge is closed. End caps block the ends of the cover. Preferably, one of these caps has a lubricant port for feeding lubricant into the channel. A cross guide, such as a cross pin, may be provided to guide the cover with respect to the pin. Some embodiments have a biasing member that pivotally biases the leaves in response to a relative position of the cover with respect to the pin.

42 Claims, 34 Drawing Sheets

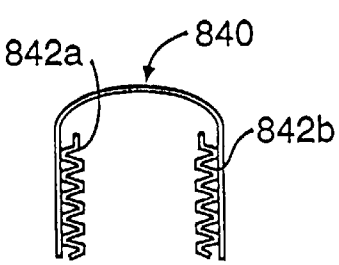
FIG. 24A
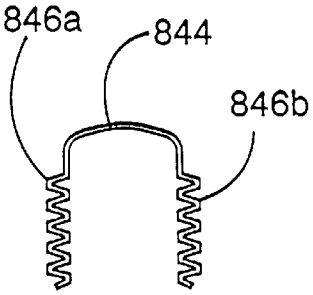
FIG. 24B
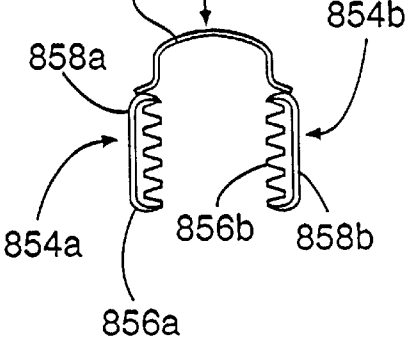
FIG. 24C
FIG. 24D
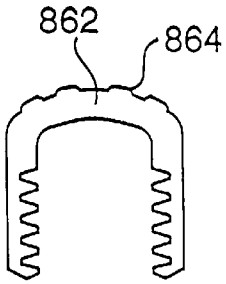
FIG. 24E

COVERED PINNED HINGE

FIELD OF THE INVENTION

The present invention relates to pinned hinges with covered knuckles. More particularly, the invention relates to a pinned hinge with knuckles protected by a cover, and with leaves that are operatively connected to a cover for moving the cover in response to pivotal movement between the leaves.

BACKGROUND OF THE INVENTION

Hinges with at least two leaves pivotably connecting structural members are known. In these hinges, the leaves generally have knuckles defining concentrically aligned cylindrical bores therethrough. A pin is inserted within the bores of the knuckles of both leaves, pivotably connecting the leaves. The bodies of the leaves are connected to the structural members.

One type of pinned hinge is known as a "butt" or "mortise" hinge. Two or more of these hinges are commonly used to hang a door from a door frame. In butt hinges, the length of each pin is short compared to the length of the door or other structural member mounted to the hinge.

"Piano" hinges are similar to mortise hinges, except that the length of the hinge and its pin usually runs most of the length of one of the attached structural member. These hinges are sometimes known as "continuous hinges".

To seal the gaps between a door and a frame between individual mortise hinges, the leaves of the hinges are often recessed or inletted into the door and the frame to a depth equal to the thicknesses of the leaves. This permits the leaves to lie flush with both the door and the frame to produce a closer fit and allow sealing when the door is closed. This is usually not necessary with piano hinges because the leaves extend approximately the whole length of the door, spanning gaps that would otherwise exist between individual mortise hinges.

To decrease gaps between opposing leaves themselves, the leaves can be swaged. Swaging involves deforming flat leaf bodies, ideally so that the leaf bodies remain parallel and can contact or almost contact each other when the door is closed.

Bearings have been placed between leaf knuckles to reduce friction between adjacent knuckles. U.S. Pat. No. 4,097,959, for example, shows ball bearings placed between knuckles of opposed leaves and the pin. U.S. Pat. No. 3,499,183, for instance, discloses the use of bushings to lower hinge friction. Washer type bushings or bearings have also been placed between adjacent knuckles.

Hinge leaves have also been pivotally biased with respect to one another to produce a self opening or closing door. U.S. Pat. No. 4,583,262 shows a hinge in which a spring coils around a split pin and resiliently biases one leaf of the hinge with respect to the other.

The knuckles of known pinned hinges, however, are exposed. This allows debris to collect within the moving parts and bearing surfaces within the hinge, causing wear, squeaking, binding, and premature hinge failure. Lubricants on the knuckles so exposed can wash away or dry out. Also, exposed knuckles are susceptible to weather that can speed corrosion of the moving parts.

Exposed pinned hinges are also subject to vandalism. The knuckles in doors that open outwardly of a building, as required by many fire codes, are located on the outside of a door. The pins retaining these knuckles are subject to removal from the outside, effectively enabling disassembly of the door and permitting unauthorized entry.

Various methods exist for retaining the pin within the knuckles. These methods include inserting a cross-pin through the pin and the knuckles; providing a knurled surface on the pin to create an interference fit with the knuckle bores; and providing one end of the pin with a wide stop that is too big to fit through the bores, and flaring out the other end of the pin once it is inserted in the knuckles. Even with these precautions, the knuckles and the pin still remain exposed and accessible to vandals.

Finally, exposed hinges generally have distracting and unsightly knuckles that extend outwardly from the plane of the door. Once corrosion sets in, exposed surfaces of these hinges become even less attractive.

U.S. Pat. No. 4,999,879 discloses a continuous hinge that is not pinned, but has a clamp that covers two hinge members. The hinge members lack knuckles and thus lack a pin to join them pivotably. Instead, the hinge members are retained laterally by the clamp against a rod fitted therebetween. The clamp and the hinge members have geared surfaces in mesh with each other. The rod keeps the hinge members in contact with the clamp, but cannot alone keep the hinge members from separating radially. This hinge relies on the clamp to pivotably join and retain the hinge members together. Thus, the clamp must be constructed with sufficient strength to support all lateral loads imposed on the hinge members. The clamp cannot be tailored to have merely sufficient strength for another intended purpose, other than joining the hinge members laterally and pivotably, such as protecting the internal hinge components from vandalism or from the elements, or for simply improving hinge aesthetics by covering moving parts. The clamp must be significantly overbuilt if this hinge is chosen merely for a function such as these. Also, as the disclosed hinge lacks interposed knuckles from the hinge members, the hinge requires the addition of thrust bearings to prevent relative, longitudinal movement between the hinge members that must be able to resist shearing between the members. Such a thrust bearing is not essential in pinned hinges because the interposed knuckles prevent relative longitudinal movement therebetween.

A need exists for a pinned hinge whose knuckles are protected and concealed by a cover. This need is especially present for a covered pinned hinge that permits pivotal movement over more than 100°, and especially more than 120° or 180°.

SUMMARY OF THE INVENTION

The invention provides a pinned hinged combination that is generally referred to herein as a hinge and that includes two hinged members. The hinged members respectively include first and second leaves that respectively have first and second knuckles. The hinged members can also include structural members attached to the leaves. A pin is received in a bore extending through the second knuckle in a longitudinal direction and is associated with the first for pivotably joining and retaining the knuckles together. Both knuckles preferably define bores, extending through the knuckles in a longitudinal direction, with the pin received through the bores to pivotably join and retain the leaves so that the knuckles of each leaf are interposed with the knuckles of the other leaf. A cover, defining a longitudinal channel, surrounds and covers the knuckles, protecting them from the environment and from vandals. Also, the leaves are operatively connected to the cover such that pivotal movement of the leaves displaces the cover with respect to the pin, moving the cover out of the pivot path of the leaves and delaying contact therewith.

In a preferred embodiment, the leaves have a position in which the cover extends circumferentially around the pin axis by at least about 270° and the leaves are pivotable more than about 100°, more preferably by more than about 120°, and most preferably by more than about 180°.

The cover preferably has a cap that blocks and preferably seals a portion of the channel. The cap is most preferably fitted and secured to an end of the cover. An embodiment of the cap has a lubricant port for feeding lubricant into the channel to lubricate moving parts therein.

In an embodiment of the hinge, the knuckles have gear sectors, and the cover has geared surfaces corresponding thereto. Preferably, the geared surfaces are racks. The gear sectors and the geared surfaces are meshed such that pivotal movement of the leaves displaces the cover radially with respect to the pin.

In one embodiment, the leaves are configured so that opening pivotal movement of the leaves displaces the cover away from the pin. To increase the angle over which the leaves can pivot, each leaf has shanks joining its leaf body to its knuckles. The shanks preferably have at least double bends so that the leaves are pivotable to a position in which the shanks cross-over each other, a shank of one leaf overlapping a shank of the other leaf along the longitudinal direction. As a result, in this position, the ends of the shank of one leaf are disposed on opposite sides of the other leaf. In an open position, concave portions of the shanks formed by the double bends surround the cover walls and permit greater pivotal movement of the hinged members.

In another embodiment, opening pivotal movement of the leaves displaces the cover towards the pin. The shank preferably has at least a triple bend such that it has a U-shaped portion that fits around walls of the cover when the hinge is open.

In another embodiment, the gear segments of one leaf have a first gear radius, while the gear segments of the other leaf have a second gear radius, with the second radius being larger than the first radius. This causes the cover to travel along a curved locus with respect to the pin when the leaves are pivoted.

The knuckles and the gear segments may be of integral construction, or made from separate pieces or materials. Where the gear segment and the knuckle are separate, an embodiment has a knuckle with a notch, and a gear segment with a tongue that mates with the notch. In another embodiment, the knuckle has a tongue, and the gear segment has a notch that receives the tongue. Pivoting of the first leaf thus causes the first gear segment to pivot therewith. The separate gear segment can include a bearing for placement between adjacent knuckles.

Another embodiment includes a seal disposed for sealing the cover to the hinged members when the hinge is in a predetermined position, such as when the hinge is closed. This seal can prevent heat, fluid, or particle flow between the hinged members. The operative connection between the cover and the leaves preferably causes the cover to compress the seal when the hinge is closed and to release the seal when the hinge is open. When one sealed hinge embodiment is closed, its seal is disposed between the cover and at least one of the hinged members on the side of the cover opposite the open side of the channel, wherein the leaves are received.

In a further embodiment, one of the hinge members includes an extension that extends over the cover. The extension and the cover are configured for selectively opening and closing an electrical circuit when the cover and the extension abut and separate.

To further control the movement of the pin with respect to the cover, an embodiment includes a cross guide attached to the cover and associated with the pin for guiding movement of the cover with respect to the pin. This cross guide can be a guide pin received transversely and slideably through the hinge pin. Alternatively, the cross guide can have a forked end comprised of guide members disposed on opposite sides of the hinge pin.

The invention also provides self opening or closing hinges. These embodiments include a biasing member associated with the cover and configured for pivotally biasing the hinged members in response to relative movement between the pin and the cover. The biasing member preferably includes a resiliently deformable structure which pivotally biases the leaves in response to a relative position of the cover with respect to the pin and causes the leaves to move. Preferably, the biasing member biases the cover along a direction substantially perpendicular to the pin.

In another embodiment, the cover itself is the resilient member. In this embodiment, a third and the first knuckles are pivotally fixed relative to each other, by being part of the same hinged member. A fourth and the second are knuckles pivotally fixed to each other. The first and second opposing knuckles move a first portion of the cover along a locus extending in a first direction with respect to the pin when the leaves pivot. The third and fourth knuckles, on the other hand, move a second portion of the cover along another locus extending in a different direction with respect to the pin when the leaves pivot. Pivoting of the leaves thus resiliently twists the cover, which pivotally biases the leaves back to their original pivotal position.

In an alternative embodiment, instead of a geared connection between the cover and the leaves, a leaf spring is attached to at least one knuckle of each leaf and also to the cover. The leaf springs are bent around the knuckles when the leaves are pivoted in one direction and straighten when the leaves are pivoted in another direction. Resiliently biased towards their normal shape, the leaf springs pivotably bias the leaves. Also, because their deformation can be predicted, the leaf springs operatively connect the leaves to the cover for repositionably displacing the cover radially with respect to the pin as the leaves pivot.

The hinge may have a plurality of leaves connected to a same structural member. The hinge may also be a piano hinge, with only two long leaves with numerous knuckles mounted about a single pin, or the hinge may have only a single knuckle on each leaf.

BRIEF DESCRIPTION OF THE DRAWINGS

FIGS. 24A–E show alternative constructions of covers according to the invention.

DETAILED DESCRIPTION OF THE PREFERRED EMBODIMENTS

Figure 1:
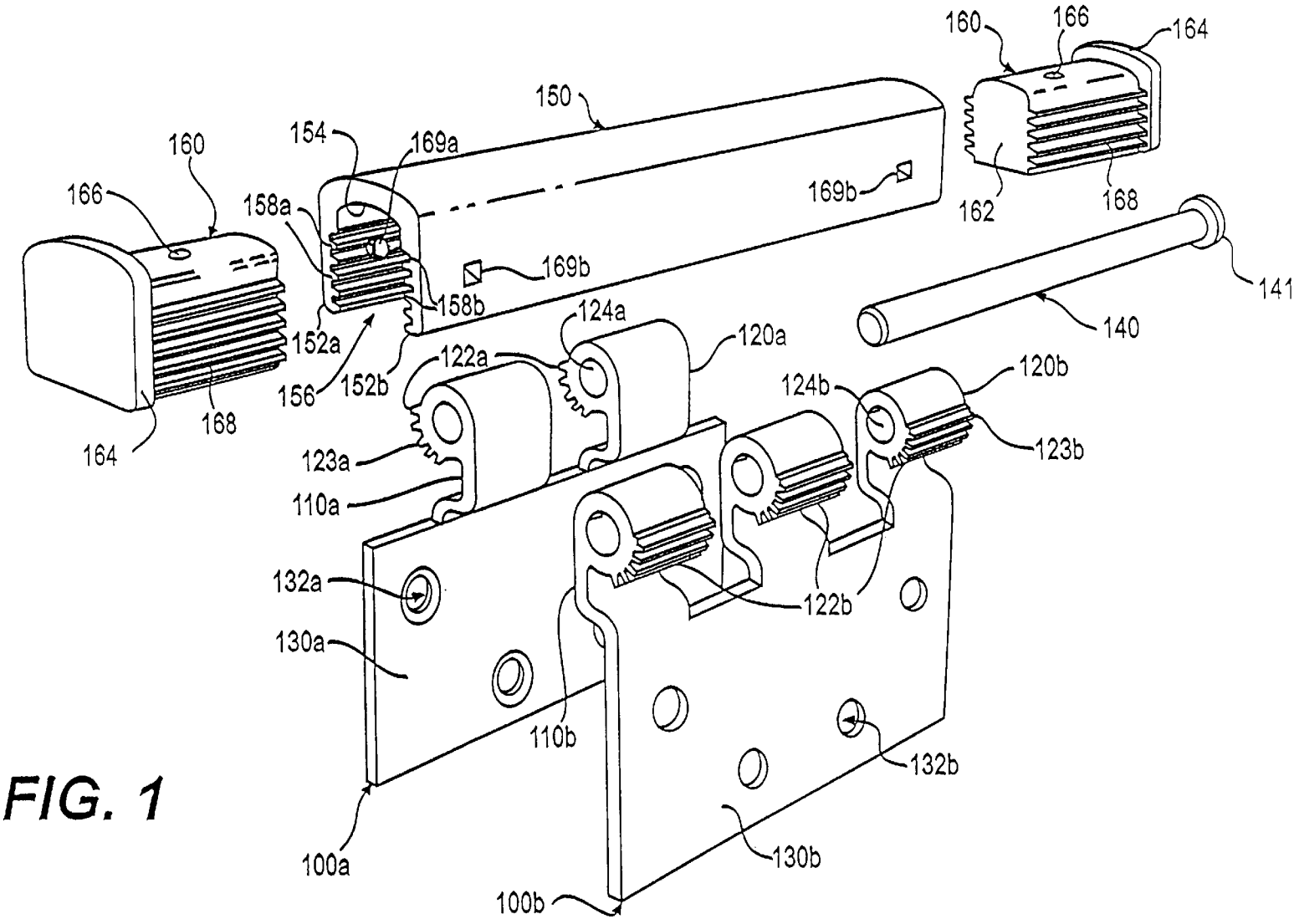
FIG. 1 is an exploded, perspective view of a hinge according to the invention.

FIG. 1 shows, in an exploded view, the components of an embodiment of a hinge according to the invention. Hereinafter, similar reference numerals beginning with a number and ending in a letter are referred to collectively by the number alone. The hinge shown has at least two hinged members including two leaves 100. Each leaf 100 has a knuckle 120, a shank 110, and a body 130.

Bodies 130 of this embodiment are flat and define openings 132 therethrough. The openings 132 are shaped to receive fasteners for fixing the respective leaf 100 to the remainder of each hinged member, such as a structural member like a door or door frame. Thus fixed, one hinged member is comprised of one of the leaves 100 and the door, and another hinged member is comprised of the other leaf 100 and the door frame. Shanks 110 connect the leaf bodies 130 to the knuckles 120, preferably extending tangentially from the knuckles 120 to provide increased clearance with the cover when the hinge is opened.

Knuckles 120 define through bores 124 that extend longitudinally and are aligned with bores 124 of other knuckles 120 of the same leaf 100. Gear sectors 122 are formed on the outer surface of the knuckles 120. The gear sectors 122 have a plurality of teeth 123. Leaf 100*b* has three shanks 110*b* and knuckles 120*b* that are spaced from each other to receive the two shanks 110*a* and knuckles 120*a* of leaf 100*a* interposed therebetween.

The leaves 100 may be manufactured from a variety of materials, including steel, aluminum, brass, and architectural or structural grades of plastics or composites; and by techniques including roll forming, extruding, casting, or otherwise molding. Also, although the knuckles 120 are shown integrally formed with the central bores 124, the leaves 100 may be made from a flat, stamped sheet, with the knuckles 122 rolled into a semicylindrical shape axially defining the bores 124.

Referring to FIGS. 1 and 2A–D, pin 140 is received through the bores 124 of the leaves 100 when the bores 124 are aligned coaxially. When assembled, the pin 140 pivotably joins the leaves 100. Pin 140 has a head 141 that facilitates assembly, as it prevents insertion through the knuckles 120 passed a predetermined point, and keeps the pin from sliding through the knuckles 120 in one direction when the hinge is assembled. Although a single pin 140 is shown, other embodiments may have multiple pins as long as at least one of the pins joins knuckles 120 of both leaves 100.

The hinge also has a cover 150. Two opposite walls 152 joined at a base 154 form the cover 150. The interior of the cover 150 defines a U-shaped channel 156 that extends longitudinally. On the interior of the cover walls 152 are geared surfaces that face each other. These geared surfaces are preferably racks 158 and correspond to and are meshed with the gear segments 122 of the leaves 100 in the assembled hinge. The cover 150 fits over the knuckles 120 to provide protection from the environment and vandalism and to conceal the knuckles 120 from view. Preferably, the cover 150 does not support a significant portion of the loads imposed on the leaves 100 or hinged members.

End caps 160 fit into the ends of the cover 150, closing and blocking the interior channel 156. The cross-sections of the caps 160 preferably match the interior of the channel 156, providing a snug fit therewith. Flanges 164 protrude laterally from the end caps 160, beyond the dimensions of the channel 156. When the caps 160 are inserted in the channel 156, the flanges 164 limit the depth of this insertion. Preferably, the flanges 164 are pressed tightly against the cover 150, so both the close fit of the end caps 160 within the channel 156 and the flanges 164 effectively seal the interior of the channel 156.

Although press or snap fits are preferred between the end caps 160 and the cover 150, these two hinge components may be cemented together. Alternatively, a rivet extending through the cover 150 and into openings 166 in the end caps 160 may fix these two members. In the embodiment shown, the cover 150 is deformed locally at indentations 169 to penetrate the sides of the end caps 160. Cross pins may otherwise be inserted through the cover 150 and end caps at the locations of the indentations 169 shown. The interlock between the gear-shaped portions 168 of the end caps 160 and the racks 158 prevents rotational movement of the end caps 160 and end-cap movement laterally towards the open side of the channel 156. The end caps 160 in this embodiment restrict longitudinal movement of the leaves 100 along the cover 150. The end caps 160 and their attachment to cover 150 are sufficiently sturdy to support the weight of the cover 150 against a topmost knuckle 120 or the top part of the pin 140.

In another embodiment, the end caps can be integrally formed with the cover. The end cap may comprise a flange extending from the cover end, which is then bent down to close the channel.

Figure 3A:
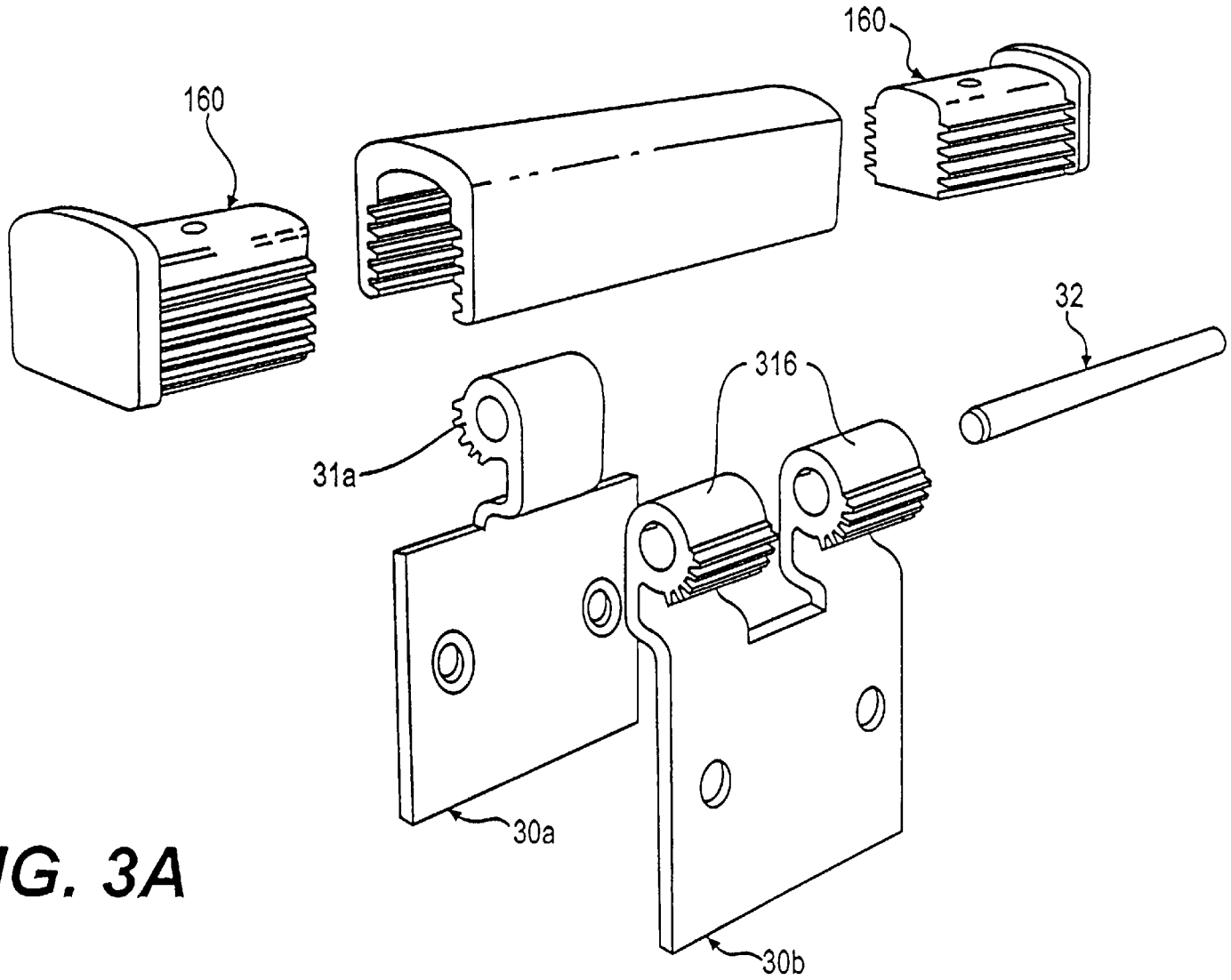
FIGS. 3A–C are exploded, perspective views of a hinge according to the invention with varying numbers of knuckles and different pin arrangements.

FIG. 3A shows a hinge in which a leaf 30*a* has a single knuckle 31*a,* which is interposed between the two knuckles 31*b* of leaf 30*b*. The pin 32 of this embodiment has a constant cross-sectional diameter, unlike the pin 140 of FIG. 1, which has a head 141. Pin 32 is retained within the knuckles 31 by the end caps 160, which are spaced from one another to provide room for the leaves 30, but preferably no additional room exceeding the amount required for the pin to slide longitudinally out from any single knuckle 31.

Figure 3B:
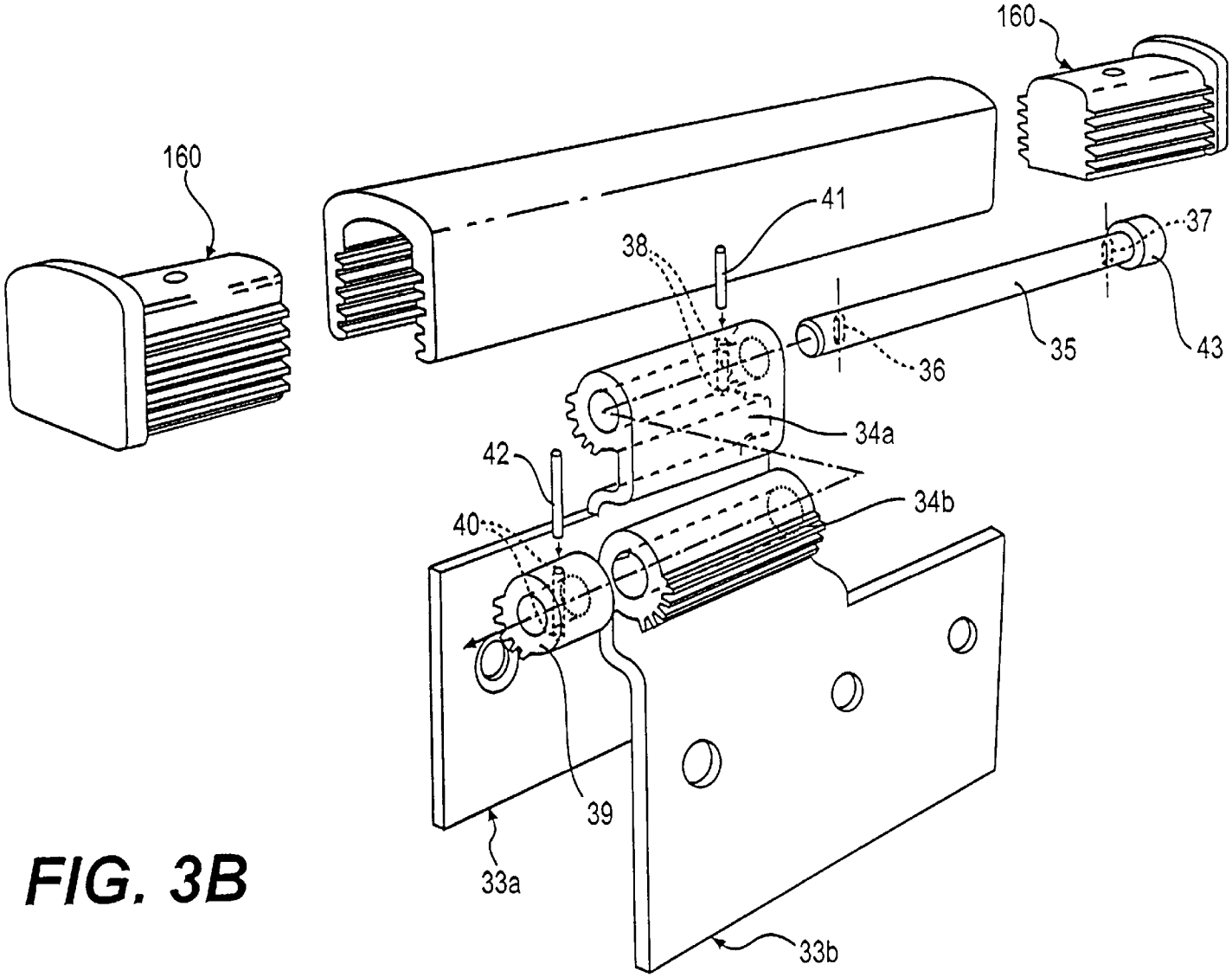

Referring to FIG. 3B, leaves 33 have a single knuckle 34 each. Pin 35 has two cross holes 36 and 37. Knuckle 34*a* has a cross hole 38 that corresponds to pin cross-hole 37, as it is aligned therewith when the hinge is assembled. A drum-shaped end piece 39 defines a cross hole 40 that corresponds and aligns with pin cross-hole 36. The pin 35 is placed through both knuckles 34 and the end piece 39. Cross pin 41 is press fit into holes 37 and 38, and cross pin 42 is press fit into holes 36 and 40, fixing the pin 35 to leaf 33*a* and to the end piece 39. Knuckle 34*b* is thus retained between the end piece 39 and knuckle 34*a*. The pin 35 preferably has a head 43 configured to stop insertion of the pin 35 into knuckle 34*a* when holes 37 and 38 are disposed at the same longitudinal location.

Figure 3C:
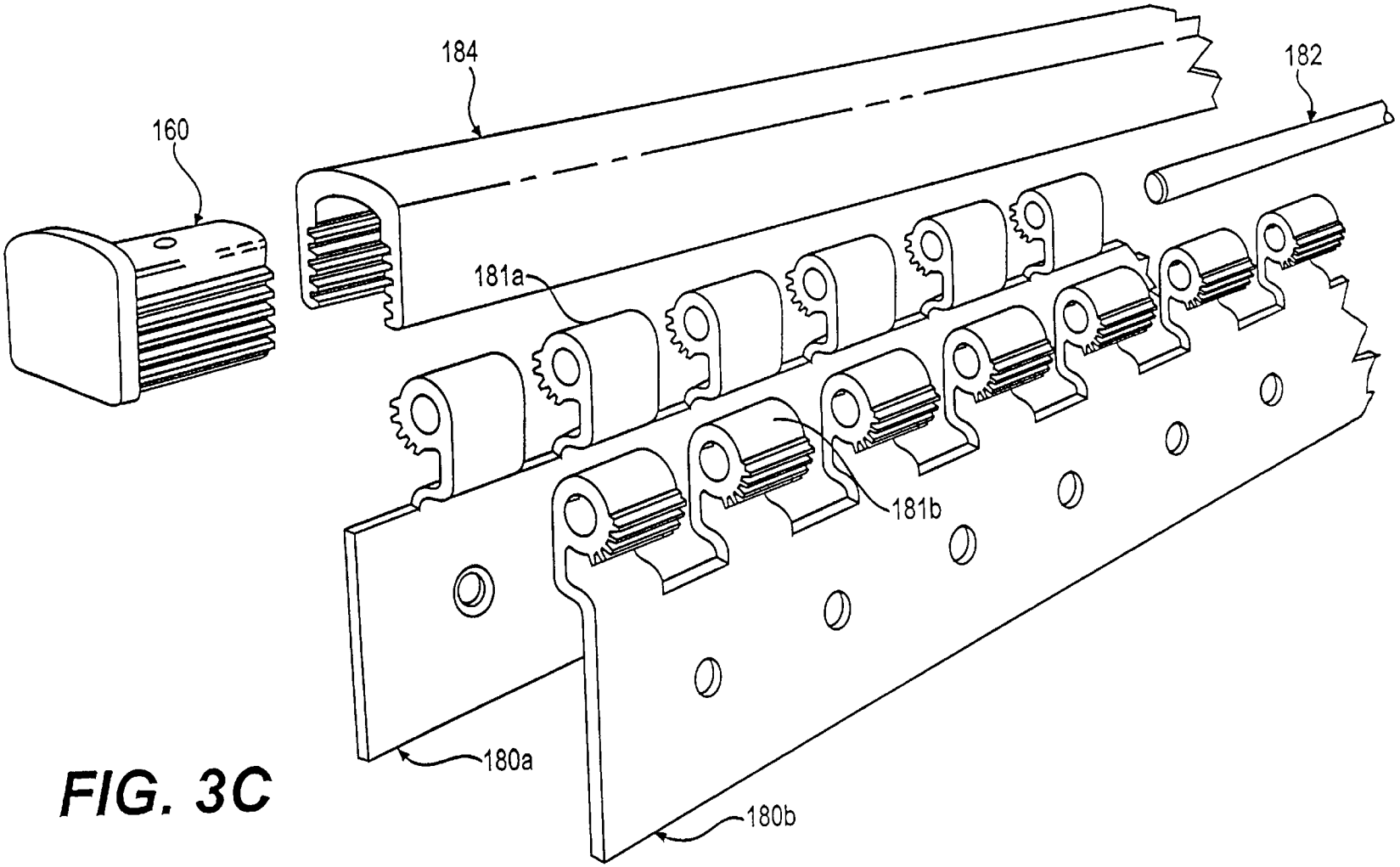

Whereas the hinge shown in FIGS. 1, 3A, and 3B are longitudinally short, FIG. 3C shows a piano hinge embodiment of the invention. Leaves 180 of the piano hinge extend most of the length of the structural members to be hinged. These leaves 180 have a larger number of interposed knuckles 181 than leaves 100 of FIG. 1.

Figure 4A:
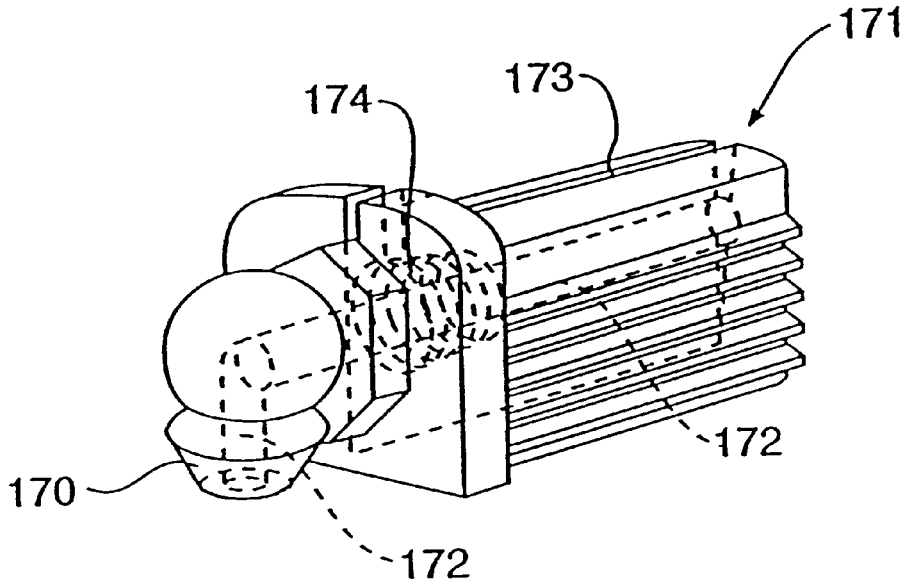
FIGS. 4A–B show a perspective and an end view of an end cap with a nipple for lubricant introduction.
Figure 4B:
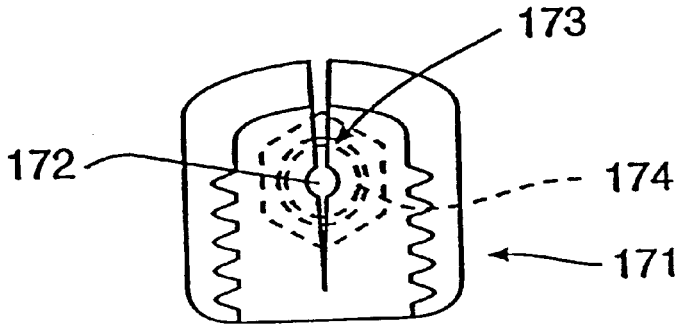
Figure 5A:
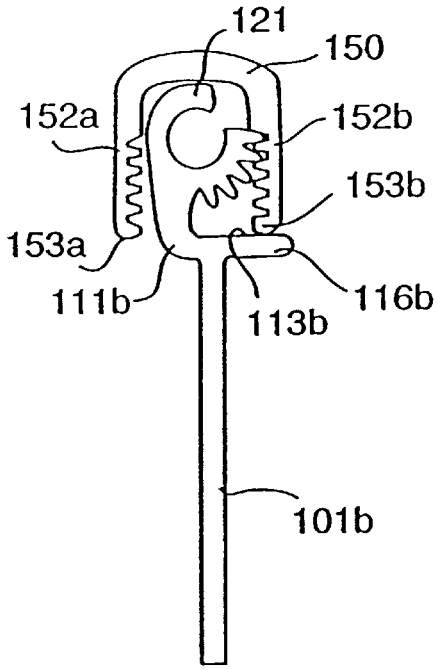
FIGS. 5A–L are end views of hinge with C-shaped knuckles.
Figure 5B:
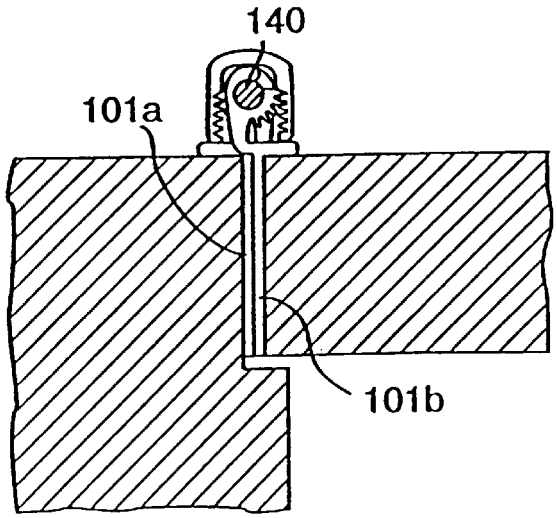
Figure 5C:
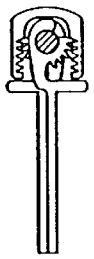
Figure 5D:
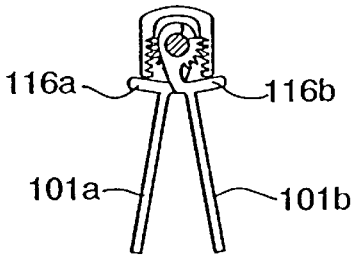
Figure 5E:
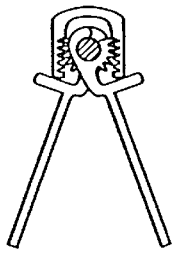
Figure 5F:
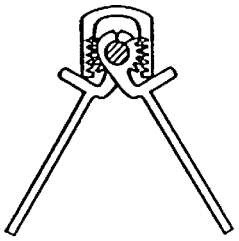
Figure 5G:
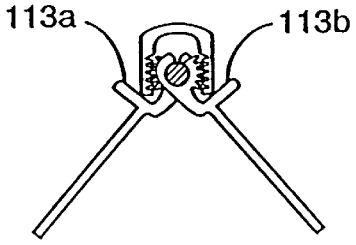
Figure 5H:
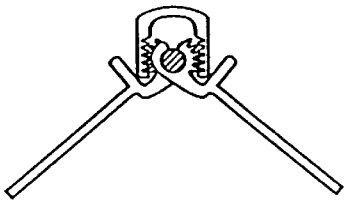
Figure 5I:
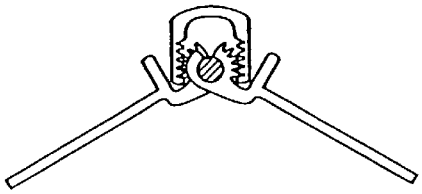
Figure 5J:
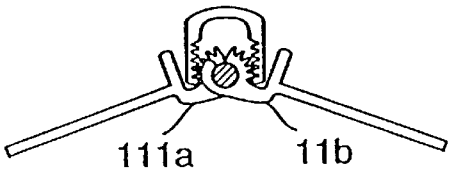
Figure 5K:
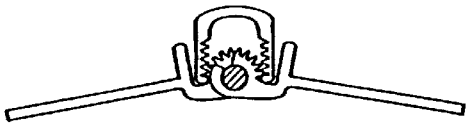
Figure 5L:
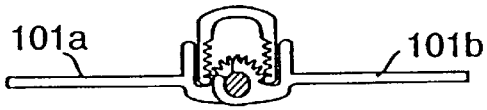

Referring to FIGS. 4A–B, an alternative end cap 171 has a nipple 170 through which to feed lubricant into channel 156. A passageway 172 passes through the nipple 170 and the length of the end cap 171. The passageway 172 is open to the channel interior 156. Lubricant introduced through the nipple 171 travels through the passageway 172 and is then distributed over the moving parts within the cover 150 during normal hinge operation.

The embodiment illustrated contains an additional feature to improve the securing of the end cap 171 to the cover 150. A slot 173 is defined through the end cap 171, substantially in parallel to the walls 152 of the cover 150 when the hinge is assembled. The passageway 172 is defined through the slot 173. The nipple 170 has a threaded male portion 174 that screws into a corresponding threaded bore communicated with the passageway 172. As the nipple 170 is screwed into the end cap 171, the male portion 174 spreads the end cap 171 at the slot 173, compressing sides 176 of the end cap 171 against the cover walls 152, improving end-cap retention within the cover 150.

Figure 2A:
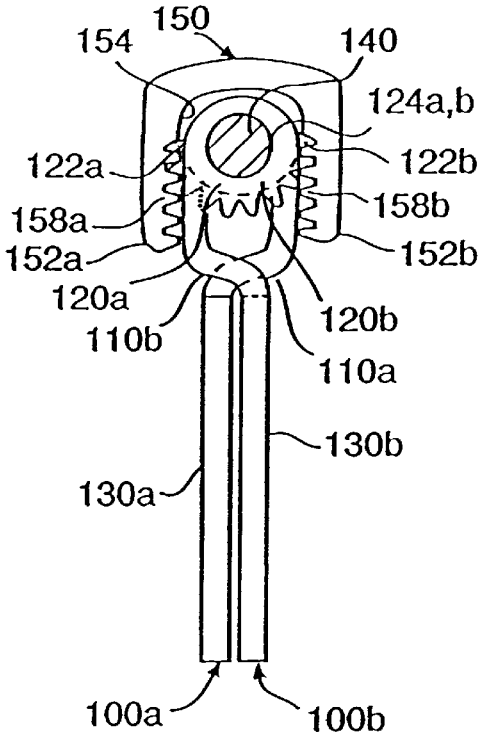
FIGS. 2A–D show cross-sectional end views of a hinge in various positions, from closed to open.
Figure 2B:
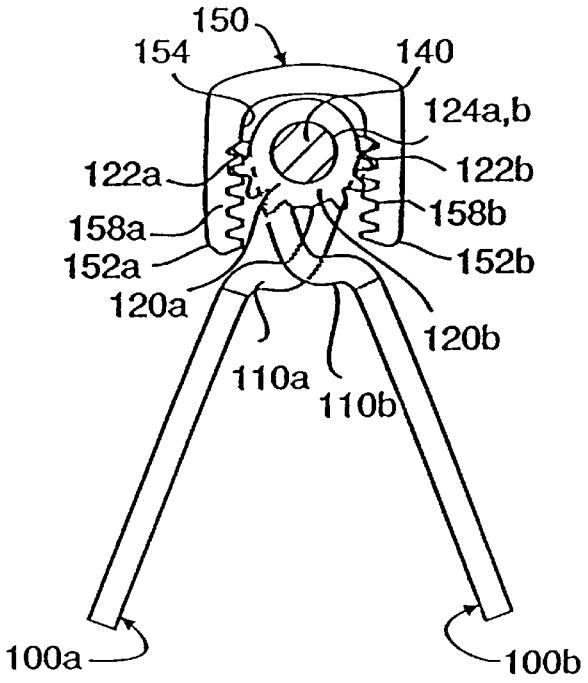
Figure 2C:
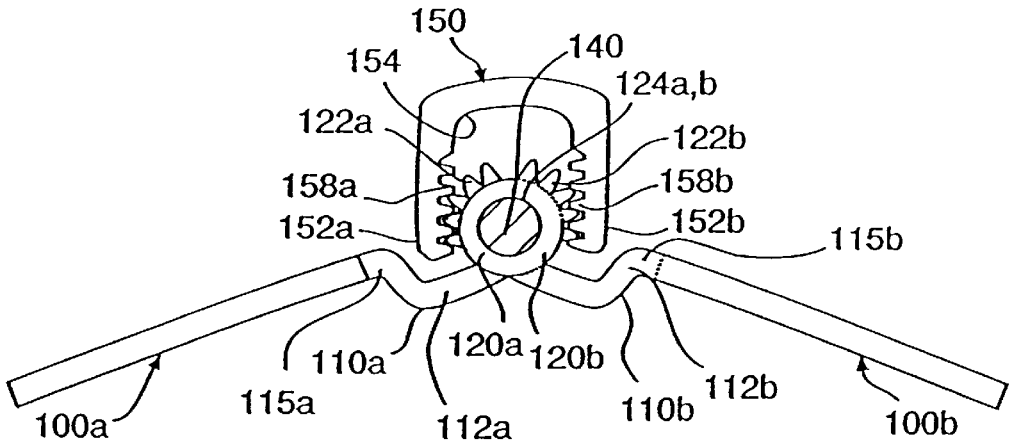

The operation of a hinge according to the invention is illustrated in FIGS. 2A–D. In FIG. 2A, the hinge is closed. As shown, the shanks 110 of this embodiment are formed with a double bend, which may be produced by swaging, extruding, or otherwise, such that the leaves 100 have a position in which the shanks 110*a* of one leaf 100*a* cross-over and overlap the shanks 110*b* of the other leaf 100*b* along the longitudinal direction parallel to the pin 140. In this embodiment, this overlap occurs at least when the hinge is closed. The shanks 110 thus cross over from one side of the other leaf 100 to the opposite side thereof. For instance, where it meets knuckle 120*a,* shank 110*a* is disposed to the right of the other leaf 100*b*. But where it meets the leaf body 130*a,* shank 120*a* is to the left of the other leaf 100*b*.

Figure 2D:
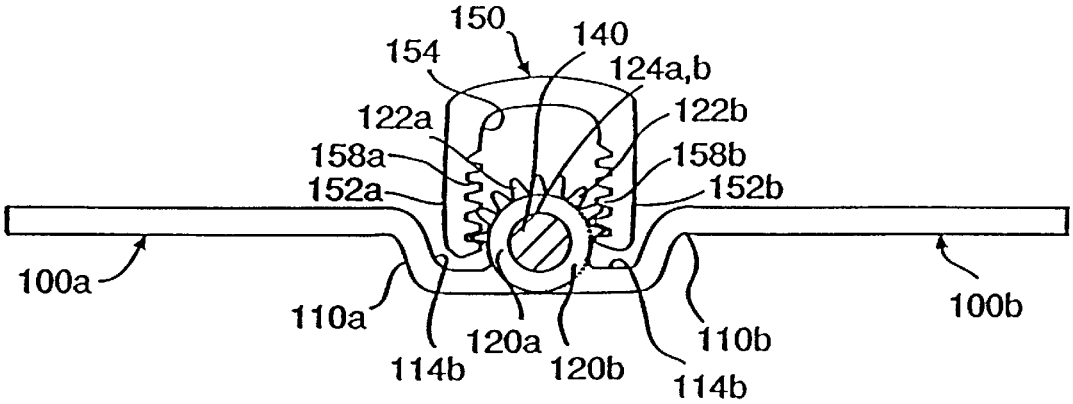

The double bends of the shanks 110 include bends 112 and 115. This curvature of the double bend shanks 120 retards interference or contact between the leaves 100 and the cover 150 as the hinge is pivoted. The double bends produce concave portions 114 of the shanks 110 that surround the walls 152 of the cover when the hinge is in an open pivotal position, as seen in FIG. 2D. The leaves 100 are thus pivotable by more than 180°. Although the shank 120 may be made without double bends, as shown in FIGS. 2E–F, double bends are preferred as they increase allowable pivot angle of the leaves 100, which is limited to about 90° with the leaves 995 of FIGS. 2E–F.

Figure 2E:
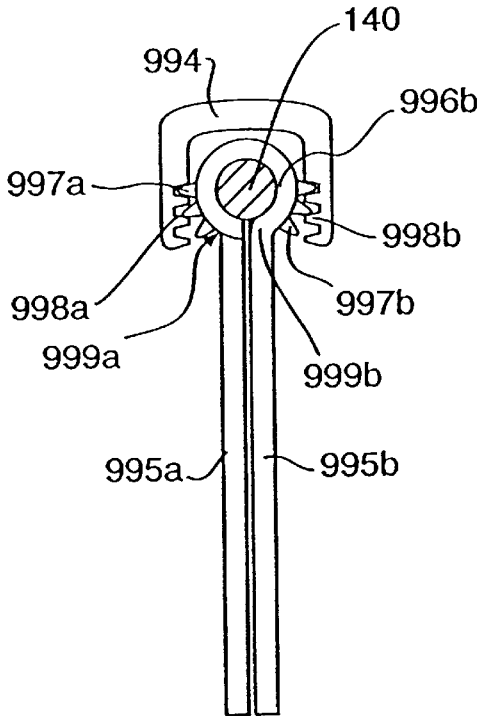
FIGS. 2E–F show cross-sectional end views of another embodiment of a hinge in various positions.
Figure 2F:
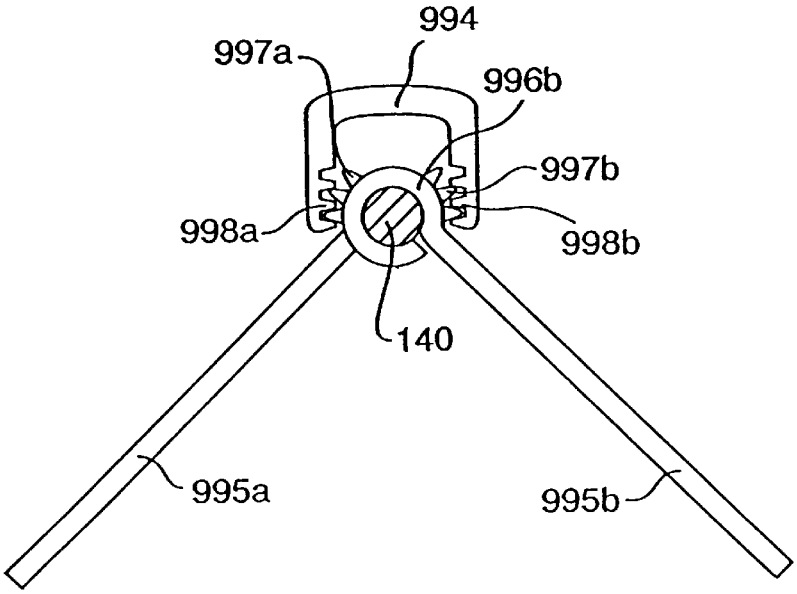

Referring to FIGS. 2E–F, gear segments 997 of knuckles 996 and racks 998 of cover 994 are shorter and extend over a smaller rotational angle about the pin 140 than the gear segments 122 and racks 158 from FIGS. 2A–D due to the limited pivotal range of the leaves 995 without double bends. Shanks 999 of leaves 995 have at most a single bend, and the shanks 999 of one leaf 995 do not cross from one side of the other leaf 995 to the opposite side thereof, as do shanks 110 of FIGS. 2A–D.

Referring again to FIGS. 2A–D, the gear segments 122 associated with the knuckles 120 are meshed with the racks 158. This mesh operatively connects the cover 150 to the leaves 100 to displace the cover 150 with respect to the pin 140 in a controlled manner as the leaves 100 are pivoted, where maintaining the cross-section of the channel 156. Preferably, this displacement is radial with respect to the pin 140. This operative connection preferably prevents the cover 150 from rocking about the knuckles 120 and provides a stable mounting surface on the channel 150 for attachments such as electrical switches. Together with the operative connection between the leaves 100 and the cover 150, the double bend shanks 110 permit operation of the preferred embodiment in which the cover 150 circumferentially surrounds the knuckles 120 and the pin 140 by at least about 270° in one pivoted position of the leaves 100, preferably permitting more than about 100° of pivotal travel of the hinged members, and more preferably more than about 120° of pivotal travel.

As the hinge is opened and the leaves 100 rotate around the pin 140, progressively from FIG. 2A to 2D, the gear segments 122 move the cover 150 away from the pin 140. The cover 150 is thus moved out of the way of the leaves 100. The distance between the walls 152 of the cover 150 and the leaf shanks 110 is controlled by the cover 150 displacement as the hinge pivots.

FIGS. 5A–L show an alternative embodiment of the hinge with leaves 101 that are manufacturable with an extrusion die that is cheaper than that required for the leaves 100 of FIGS. 2A–D. Knuckles 121 of the leaves 101 are C-shaped in cross-section. As seen in FIGS. 5C–L, the C-shaped knuckles 121 contact the pin 140 at points spread over more than 270°. This angle may be smaller than 270°, but is preferably more than 180° to adequately retain the leaves 101 in pivotable engagement. The extrusion die required to produce these knuckles 121 need not produce a closed circular cross-section, reducing manufacturing costs.

Also, the leaves 101 include lips 116 which extend laterally adjacent the shanks 111. The shanks 111 have double bends and an outer surface 113 which is contiguous along the shanks 111 and lips 116 and is contoured to travel close to or in contact with the ends 153 of walls 152 of the cover 150 as the hinge is pivoted, as shown in FIGS. 5C–L.

Figure 6A:
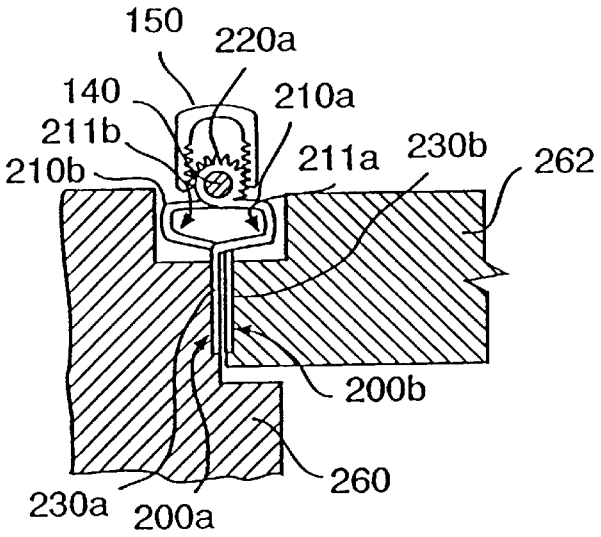
FIGS. 6A–E are cross-sectional end views of another embodiment of the inventive hinge in various positions, from closed to open.
Figure 6B:
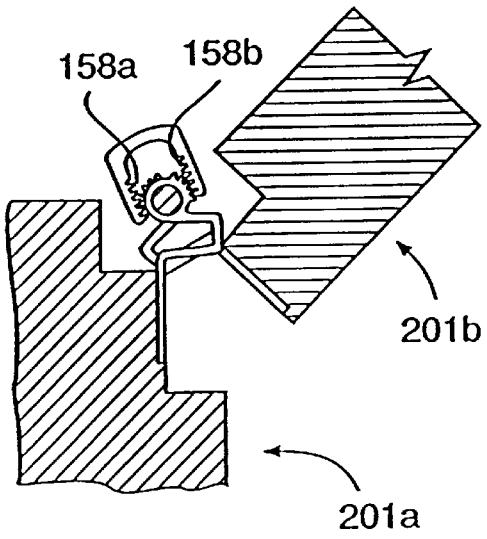
Figure 6C:
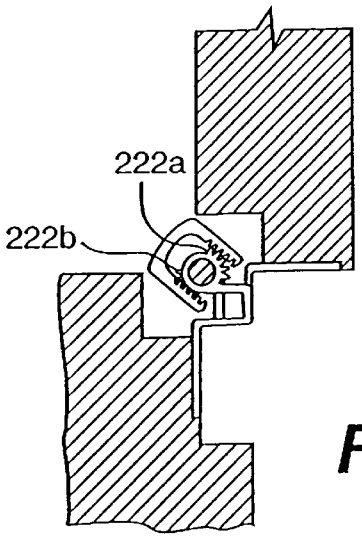
Figure 6D:
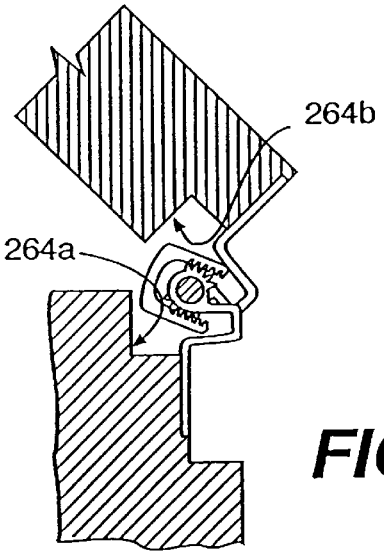

Whereas the leaves 100 and the cover 150 in FIGS. 2A–D and 5A–L are configured and dimensioned such that opening pivotal movement of the leaves 100 displaces the cover 150 away from the pin 140, the opposite is true in the embodiment of FIGS. 6A–E. FIGS. 6A–E progressively show the opening pivoting movement of this hinge embodiment. As the hinge opens, knuckles 120 and pin 140 move deeper into the cover 150. In other words, the cover 150 moves radially towards the pin 140. When the hinge is closed, as shown in FIG. 6A, the gear segments 222 and are meshed towards the outer end of the racks 158. When the hinge is closed, the operative connection between the leaves 200 and the cover 150 places the gear segments 222 toward the inner end of the racks 158.

One leaf 200*a* is affixed to a door frame 260, and the other leaf 200*b* is affixed to a door 262. When the hinge is closed, as shown in FIG. 6A, leaf bodies 230 are preferably disposed close to or contact each other. The shanks 210 of leaves 200 have triple bends, as they have a concave portion 211 with a deep U-shaped cross-section in a plane substantially perpendicular to the axis of the pin 140. The base of the U-shaped portion of each shank 210 is disposed towards a direction opposite the body 230 to which it is connected. When the hinge is opened, the shanks 230 extend around the cover walls 152. This shank shape keeps the shanks 210 out of the way of the cover 150 during pivoting of the leaves 200.

Figure 6E:
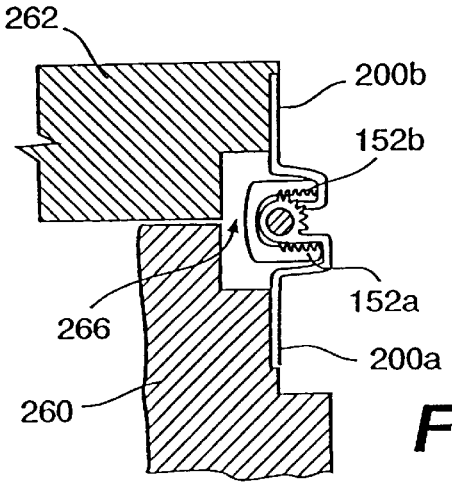

Both the door and the frame have recessed portions 264 that extend longitudinally, parallel to the pin 140. When the hinge is closed, as shown in FIG. 6A, recess 264*a* receives shank 210*b,* and recess 264*b* receives shank 210*a.* As seen, each recess 264 receives the shank 210 that is fixed to the other of the structural members: the door frame 260 or the door 262. As the hinge is opened, the cover 150 is moved out of the relative arcs of travel of these structural members 260 and 262. When the hinge is completely open, as shown in FIG. 6E, the cover 150 is contained within the space 266 defined by both recessed portions 264 and the hinge. In this embodiment, hinged member 201*a* includes door frame 260 and leaf 200*a,* and hinged member 201*b* includes door 262 and leaf 200*b.*

Figure 6F:
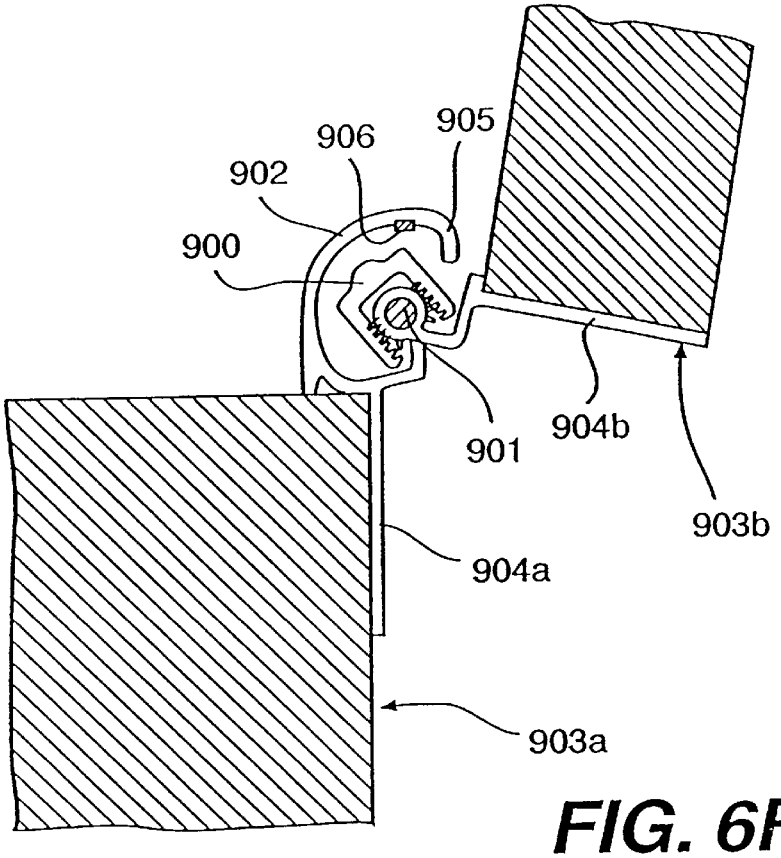
FIGS. 6F–6G are cross-sectional end views of a hinge with electrical contacts along an extension of a hinged member.
Figure 6G:
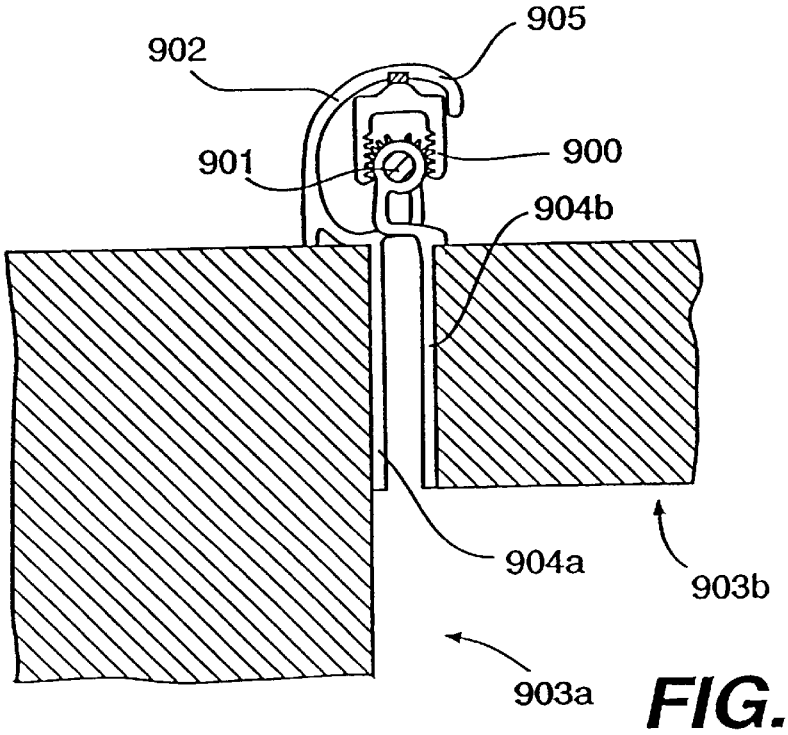

In the embodiment of FIGS. 6F–G, as in the embodiment of FIGS. 6A–E, cover 900 moves radially towards pin 901 when the hinge is opened, and radially away from pin 901 when the hinge is closed. An arcuate extension 902 extends from at least one of the hinged members 903, in this case from leaf 904*a.* The extension 902 extends around the cover and has an end 905 that substantially closes the space between the cover 900 and the interior of the extension 902.

The interior of the extension 902 houses electrical contacts 906 (only one of which is shown) disposed at different locations along the length of the extension 902. The contacts 906 are electrically insulated from the extension 902. The cover 900 comprises an electrical conductor such that a circuit is formed between the contacts 906 and the cover 900 when the hinge is closed and the cover 900 abuts the contacts 906, as shown in FIG. 6G. If an intruder attempts to pry open the hinge by bending the extension 902 away from the cover 900, the circuit will be broken when the cover 900 and the contacts 906 separate, preferably setting off an alarm. Alternatively, the contacts 906 can be replaced with switches to perform similar or different functions.

Figure 7A:
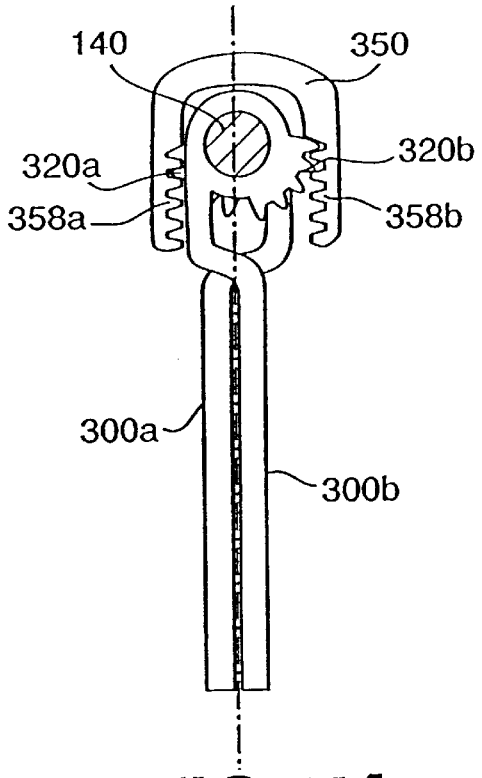
FIGS. 7A–B show cross-sectional end views of a hinge with gear segments of different radii.
Figure 7B:
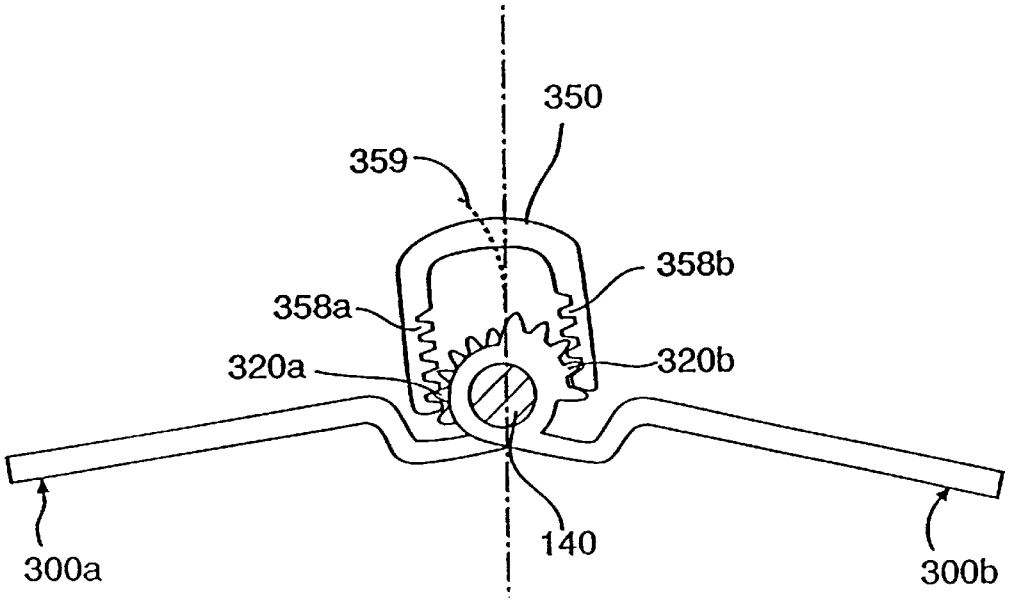

The leaves 300 of the embodiment of FIGS. 7A–B have gear segments 320 of different radii. Cover 350 also has corresponding racks 358 with different geared-surface radii. Because the gear radius of gear segment 320*b* is larger than the gear radius of gear segment 320*a,* a predetermined amount of pivoting of the leaves 300 causes a greater displacement of rack 358*b* than of rack 358*a.* Hence, as the hinge is opened, as seen in FIG. 7B, the cover travels along an arcuate locus 359, with respect to the pin 140, that is curved towards leaf 300*a.* By selecting an appropriate difference in gear segment 320 radii, the locus 359 of the cover 350 can be altered. Furthermore, non-circular gear segments and differently shaped cover walls may be employed to further alter the locus of the cover to provide virtually any position with respect to the pin at any pivotal position of the leaves.

Figure 8B:
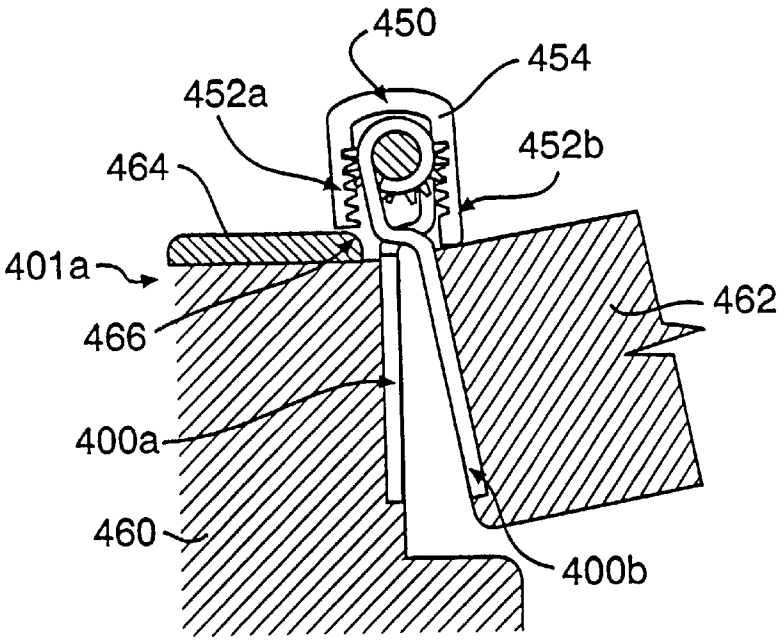
FIGS. 8A–D show cross-sectional end views of a hinge with a sealing pad.
Figure 8A:
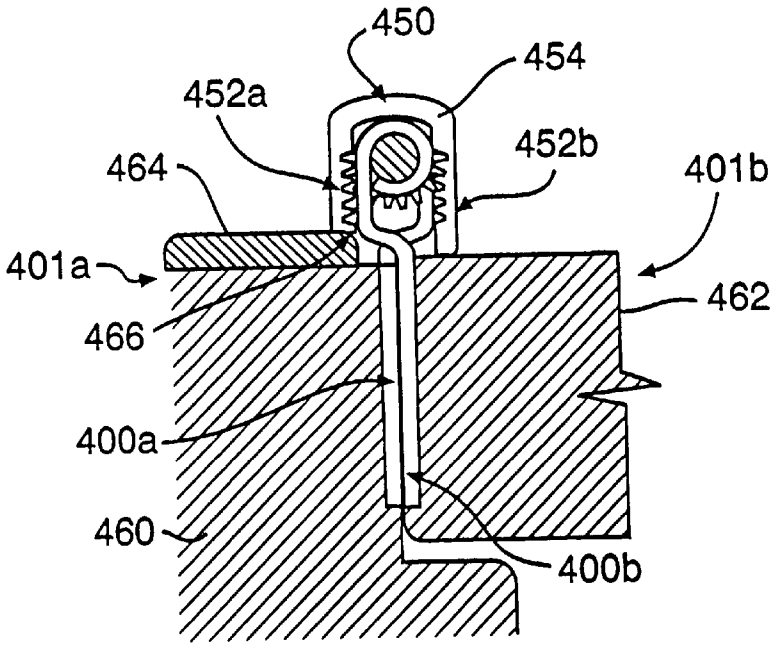
Figure 8D:
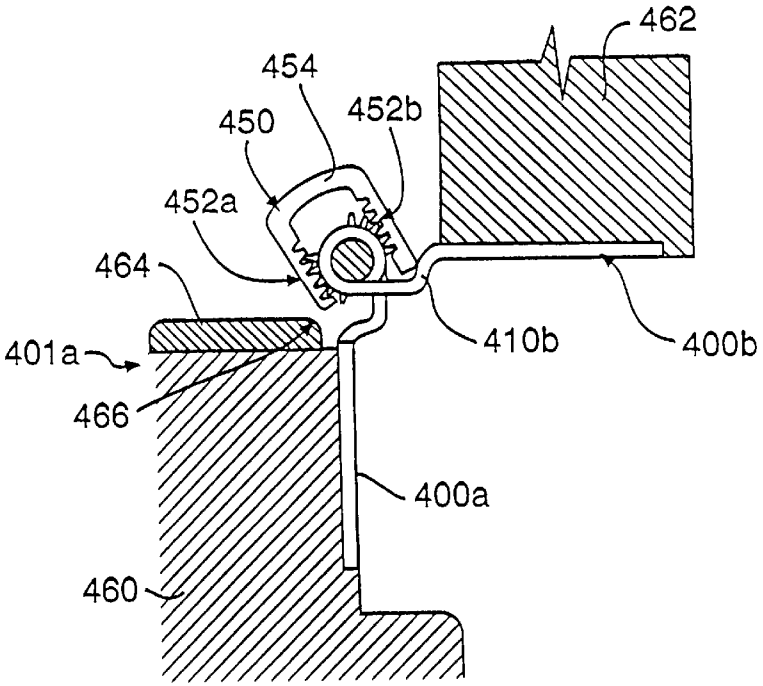
Figure 8C:
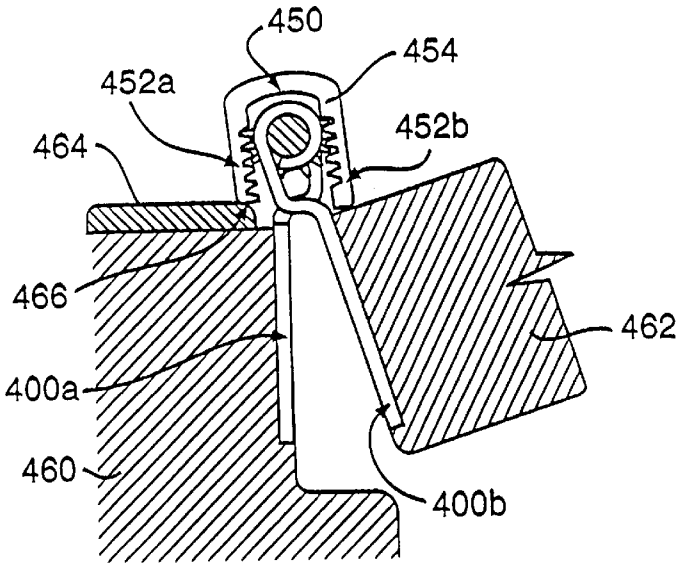

Referring to FIGS. 8A–D, the cover 450 of the hinge can also be used to positively seal the hinged members 401, including, in this embodiment, leaves 400 and structural members comprising door frame 460 and door 462. The hinge shown is pivotable by more than 90°. A seal in the form of sealing pad 460 is fixed to door frame 460. Cover wall 452*a* is shorter than cover wall 452*b.* When the hinge is closed, the shorter cover wall 452*a* abuts in sealing contact the sealing pad 464, and the longer wall 452*b* contacts door 462. In this position, the cover 450 is sealed to the door frame 460 and the door 462. An edge 466 of the sealing pad 464 is rounded to permit the shorter cover wall 452*a* to move with respect thereto without catching as the hinge opens, as shown in FIGS. 8B–C, but to produce the seal shown in FIG. 8A when the hinge is closed.

Although the longer wall 452*b* of cover 450 is part thereof, it and the door 462 are also a seal. The longer wall 452*b* is shaped to abut and seal against the door 462 when the hinge is closed, and to move away from the door 462 as it opens.

Opening pivoting movement of this embodiment is limited to the pivoting position at which the longer cover wall 452*b* contacts shank 410*b* of leaf 400*b.* This shank 410*b* is also configured to allow the longer cover wall 452*b* to travel relative thereto as the hinge is pivoted.

Figure 9:
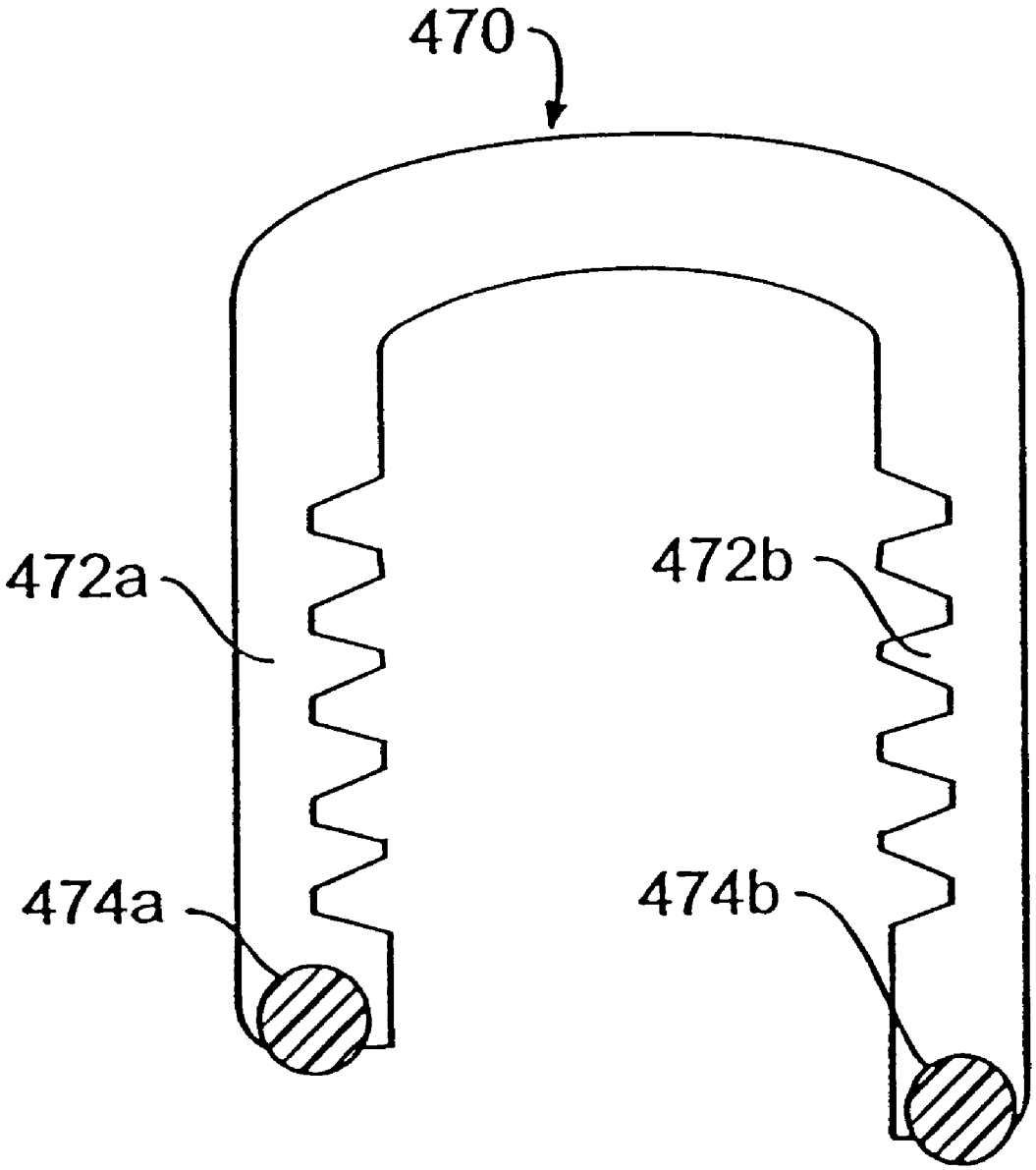
FIG. 9 is a cross-sectional end view of a cover with seals on ends of cover walls.

FIG. 9 shows an alternative cover 470 with resilient gasket seals 474 extending along the ends of the cover walls 472. The gaskets 474 improve sealing to the hinged members on both sides of the cover 470. A hinge employing cover 470 with gasket seals 474 may not need the additional sealing pad 464 shown in FIGS. 8A–D.

The hinge embodiment of FIGS. 5A–L is particularly suited for use with cover 470 of FIG. 9. The outer surface of the lips 116 and shank 111 can be configured as wipers to wipe the gaskets 474 each time the hinge is pivoted.

Figure 10C:
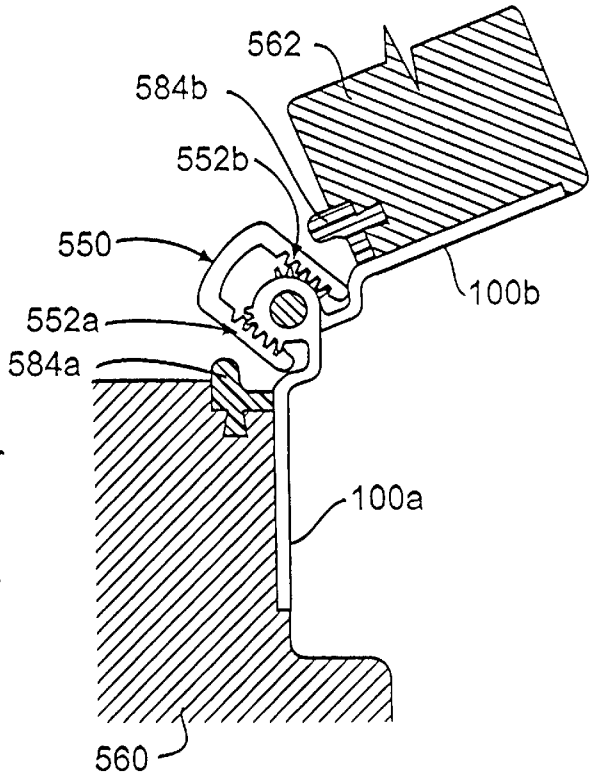
FIGS. 10A–C show cross-sectional end views of a hinge with seal inserts mounted to hinged members.
Figure 10B:
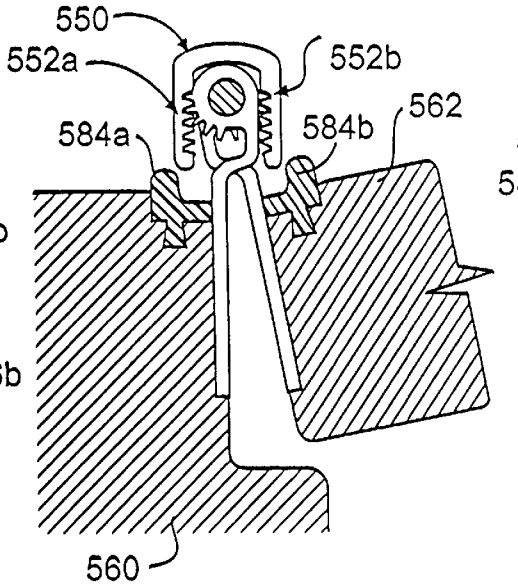
Figure 10A:
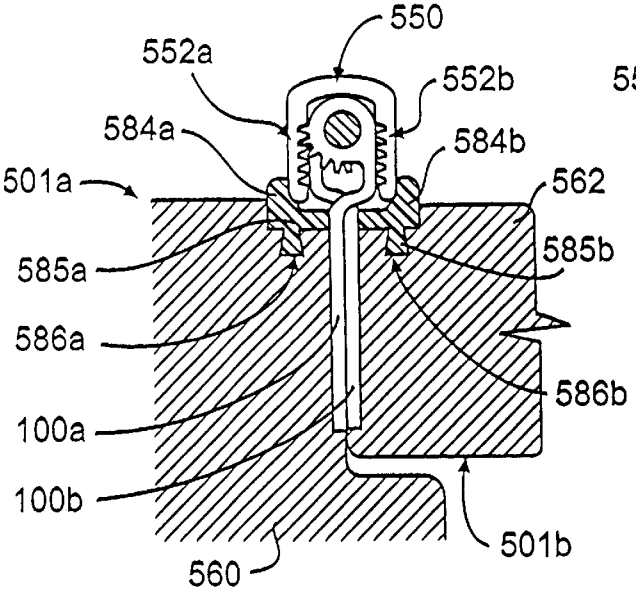

The embodiment of FIGS. 10A–C has a cover 550 with cover walls 552 of substantially equal lengths. Resilient seal inserts 584 are secured to the structural members: door frame 560 and door 562. Thus, the seal inserts 584 are coupled to move with the leaves 100. When the hinge is closed, the cover 550 presses into the seal inserts 584, sealing the space within the cover 550 from the outside. As the hinge is opened, the cover 550 moves away from the seal inserts 584, permitting the hinge to pivot.

The seal inserts 584 have tongue portions 585 that are press or snap fit into grooves 586 in the structural members 560 and 562. This tongue-in-groove fit seals the seal inserts 584 to the structural members 560 and 562 and secures them thereto.

Also, the seal inserts 584 extend laterally up to the leaves 100, and are in contact therewith, improving sealing. This contact between the seal inserts 584 and the leaves 100, however, is not necessary in the shown embodiment if adequate sealing is accomplished between the cover walls 552 and the seal inserts 584.

Figure 11B:
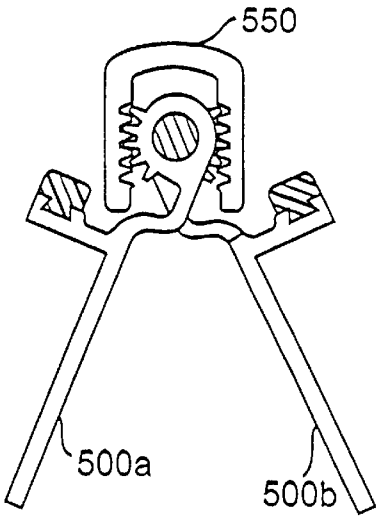
FIGS. 11A–C are cross-sectional end views of a hinge with seal supporting members extending from leaves.
Figure 11A:
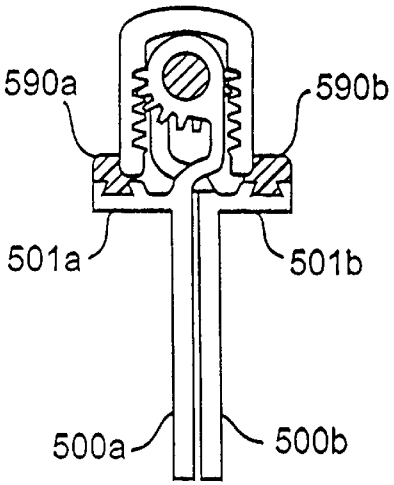
Figure 11C:
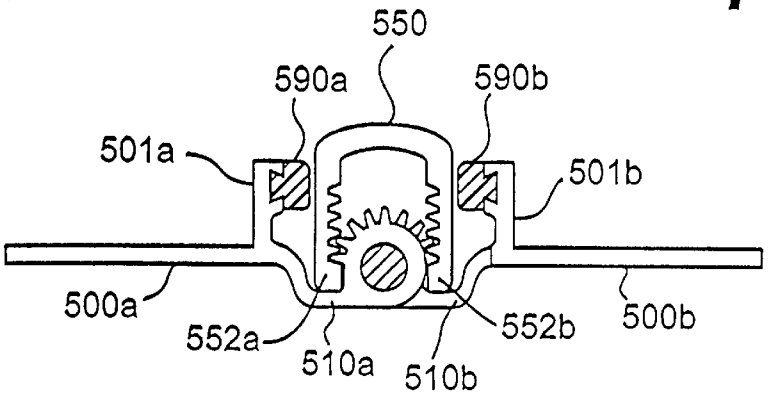

The embodiment of FIGS. 11A–C is similar to the one of FIGS. 10A–C, except that seal inserts 590 are fitted to seal supporting members 501 of leaves 500. This hinge embodiment with seal supporting members 501 does not require additional seals affixed to the door and door frame to which it is attached. As shown in FIG. 11C, the opening pivoting travel of the leaves 500 stops where the cover walls 552 and the shanks 510 contact. In an alternative embodiment with shorter cover walls, the opening pivoting travel can be limited when the seal inserts 590 contact the sides of cover walls 552.

Referring to FIGS. 12A–D, leaves 50 are fastened to structural members 52. The hinged structural members 52 have arcuate portions 54 that extend around cover 56. Sealing extensions 58 protrude laterally from the cover 56 towards the arcuate portions 54 of the structural members 52. These sealing extensions support resilient gaskets 60. When the hinge is closed, the gaskets 60 are compressed between the sealing extensions 58 of the cover 56 and the arcuate portions 54 of the structural members 52, sealing the space between the structural members.

The cover 56 and leaves 50 are operatively connected in a manner similar to the leaves 200 and the cover 150 of FIGS. 6A–E. As the hinge opens, the cover 56 moves towards pin 140, and as the hinge closes, the cover 56 moves away from the pin 140. The shanks 62 and the ends of the arcuate portions 54 of the structural members 52 of this hinge are configured to limit the pivoting of the hinge to slightly more than 90°.

Figure 12A:
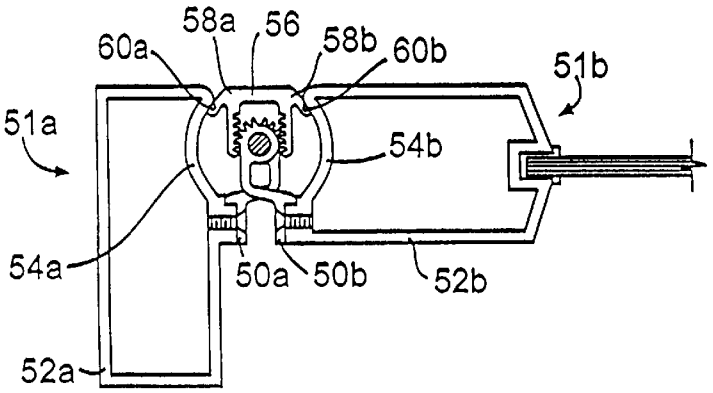
FIGS. 12A–D are cross-sectional end views of a hinge with seals on the outside of a hinge cover.
Figure 12B:
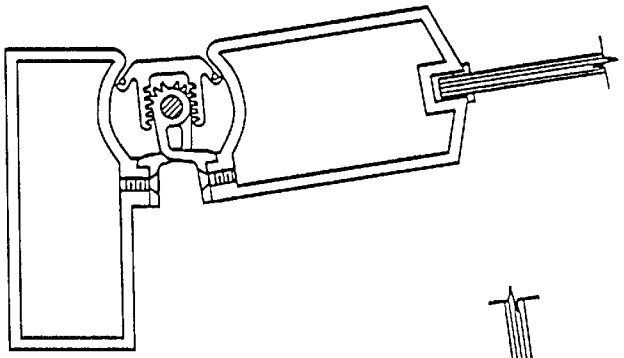
Figure 12C:
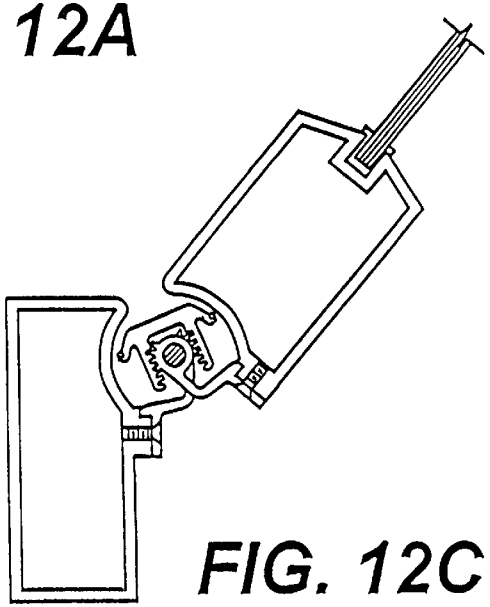
Figure 12D:
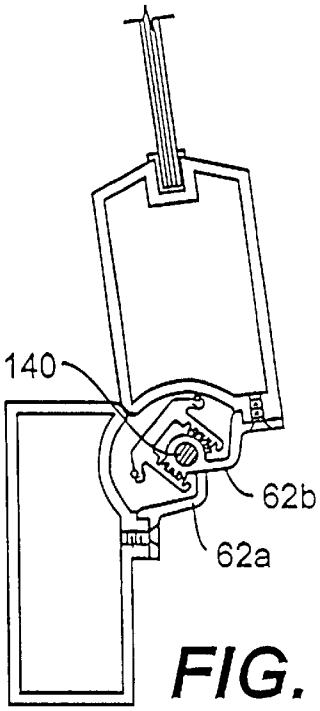

As shown in FIG. 12D, the cover 56 is not in contact with the structural members 52. Instead, it is enclosed within the arcuate portions 54. In another embodiment however, the arcuate portions and the operative connection between the cover and the leaves can be tailored so the cover slides along the arcuate portion, never loosing its seal therewith.

In the embodiment shown, one hinged member 51*a* includes leaf 50*a* and structural member 52*a*, and the other hinged member 51*b* includes leaf 50*b* and structural member 52*b*. The leaf 50 and structure member 52 of each hinged member 51 interact functionally. In most embodiments, one of the hinged members may comprise an entire door.

Figure 13B:
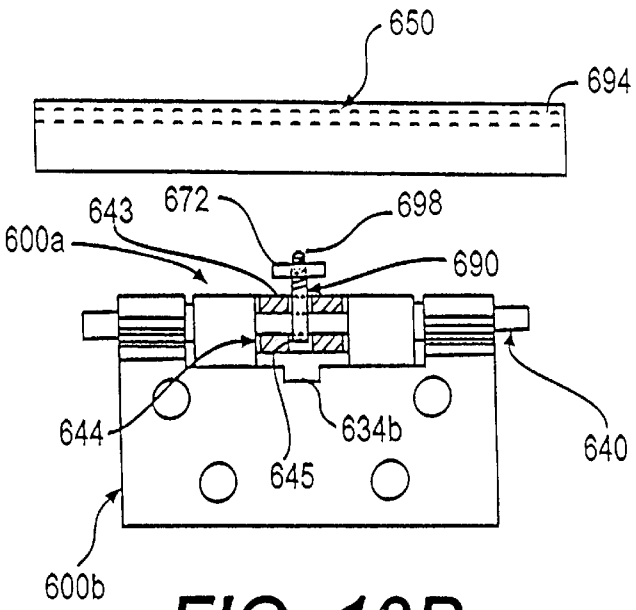
FIGS. 13A–B show a perspective and a side exploded view of a hinge with a pin mounted on a cross guide.
Figure 13A:
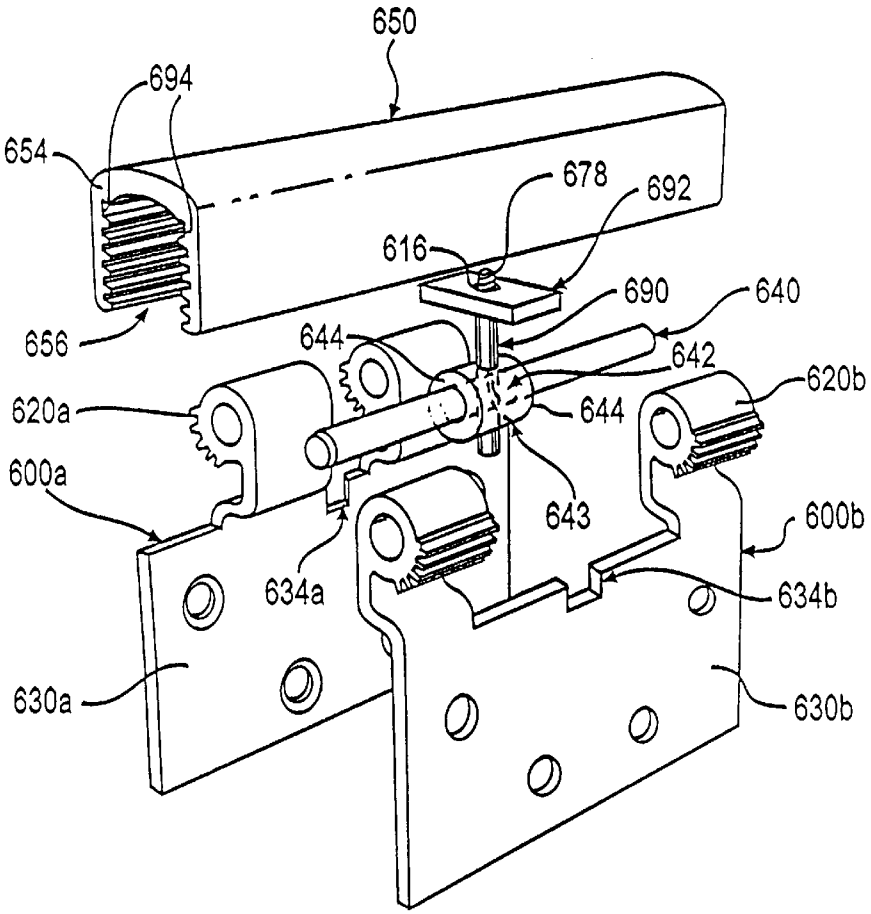

FIGS. 13A–B show an embodiment of a hinge with an additional interconnection between a cover 650 and a pin 640. Within channel 656 of cover 650, preferably adjacent the cover base 654, the cover 650 defines longitudinal keyways 694 that extend along the length of the cover 650. A mount plate 692 fits within the keyways 694. Mount plate 692 includes a tapped bore 696 for receiving a cross guide 690. The cross guide 690 is preferably a cylindrical pin with a threaded portion 698 that is screwed against the cover base 654, securing the mount plate 692 and the cross guide 690 in place.

Pin 640 defines a bore 642 transversely therethrough dimensioned to slideably receive the cross guide 690. Pin 640 pivotably joins leaves 600. Instead of having three knuckles 620, as does leaf 100 of FIG. 1, a central knuckle is missing to make room for the cross guide 690 when the hinge is closed.

During operation of the hinge, the cross guide 690 prevents pin 640 from rotating relative to the cover 650. Cross guide 690 helps maintain the locus of the cover 650 with respect to the pin 640. Additionally, the cross guide 690 ensures that the knuckles 620 of the two leaves 630 rotate through the same angle with respect to the pin 640. Thus, each knuckle 630 rotates about the pin 690 over half the angle over which rotate knuckles of a hinge in which another leaf is fixed to the hinge pin. As a result, wear is reduced and equalized in both leaves 630. Also, the leaves 600 define notches 634 aligned with the cross guide 690 such that when the hinge closes and the leaves 600 move towards the cover 650, leaf bodies 630 do not interfere with the cross guide 690.

A cylindrical guide sleeve 643 is slideably mounted on pin 640. The sleeve 643 defines a traverse hole aligned with the bore 642 and configured for receiving the cross guide 690. On the longitudinal ends of the sleeve 643 are end faces 644 that limit the longitudinal travel of the leaves 630 when the knuckles 620 contact the end faces 644. The hinge of this embodiment thus does not require end caps on the cover 650 because the cross guide 690 and guide sleeve 643 retain the leaves 630 and the pin 640 within a predetermined longitudinal position with respect to the cover 650. The arrangement of this embodiment also eliminates any need to secure the pin 640 to one of the knuckles 620. In an alternative embodiment without the sleeve 643, knuckles 630 disposed adjacent the cross guide 690 can be spaced close to the cross guide 690, fulfilling the function of the sleeve 643.

Figure 13D:
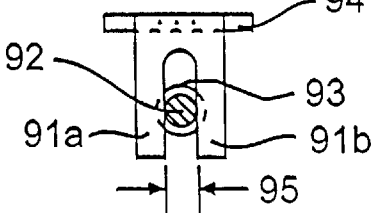
FIG. 13D is an end view of the cross guide and pin of FIG. 13C.
Figure 13C:
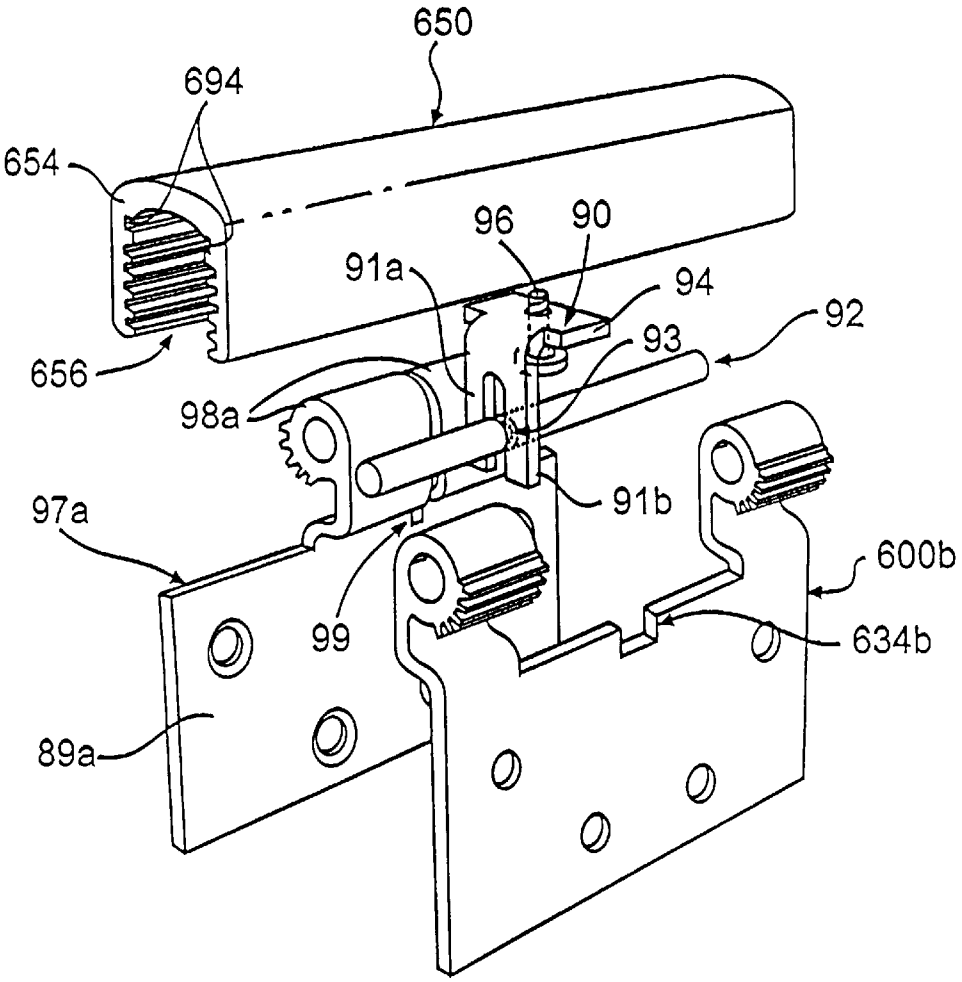
FIGS. 13C is an exploded perspective view of another embodiment with a cross guide.

Another embodiment employing a cross guide is illustrated in FIGS. 13C–D. The cross guide 90 is a bent sheet of metal with base 94 and a forked end, which includes guide members 91 defining a space 95 therebetween. The base 94 of cross guide 90 fits within keyways 694 of the cover 650 and is secured to the cover 650 by screw 96. Pin 92 preferably has a groove 93 which is received within the space 95 of the forked end of the cross guide 90. The outer diameter of the pin 92 is larger than the space 95 so that the cross guide 90 is retained longitudinally with respect to pin 92.

Leaf 600*b* from FIGS. 13A–B can be used with the embodiment of FIGS. 13C–D. Notch 634*b* allows the leaf 600*b* to pivot without being blocked by the cross guide 90. Leaf 97*a* has knuckles 98, which are separated longitudinally by little more than the thickness of the cross guide 90. Thus, when assembled, the cross guide 90 is retained longitudinally with respect to the leaves 97*a* and 600*b*. Notch 99 in leaf 97*a* serves a similar purpose as notch 634*b*, allowing the body 89*a* of leaf 97*a* to pivot past the cross guide 90.

Figure 14:
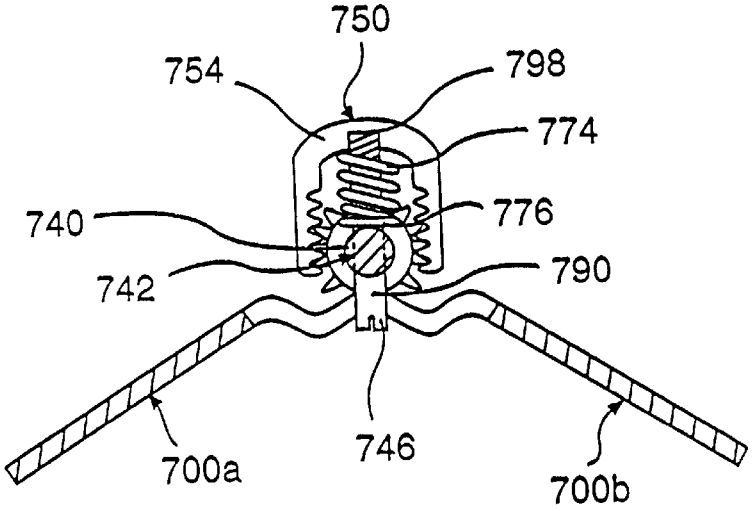

The embodiment of FIG. 14 has a cross guide 790 with a threaded end 798 screwed directly into a threaded hole in cover 750. The end 796 of the cross guide 790 opposite the threaded end 798 is configured to receive a tool such as a screw driver for securing the cross guide 790 to the cover 750 once leaves 700 are assembled into the cover 750. A transverse bore 742 through pin 740 slideably receives the cross guide 790.

A resilient biasing member biases the cover 750 away from the pin 740. In this embodiment, the biasing member is a helical spring 774 disposed surrounding the cross guide 790. A plate or washer 776 is fitted between and against the spring 774 and the pin 740. The spring 774 is thus compressed as the hinge is closed and the pin 740. The spring 774 biases the cover 750 away from the pin 740, automatically opening the hinge. Consequently, the leaves 700 are biased in response to a relative position of the cover 750 with respect to the pin 740. Although in this embodiment, this bias forces the cover 750 in a direction perpendicular to the pin 740, the locus of the cover 750 may be curved in other embodiments. As will be understood, the helical springs described herein can be replaced by other biasing members, such as elastomeric rods, solenoids, and hydraulic or pneumatic actuators. Dampers may also be employed as the biasing member in order to control impact loads on the hinged members.

Figure 15:
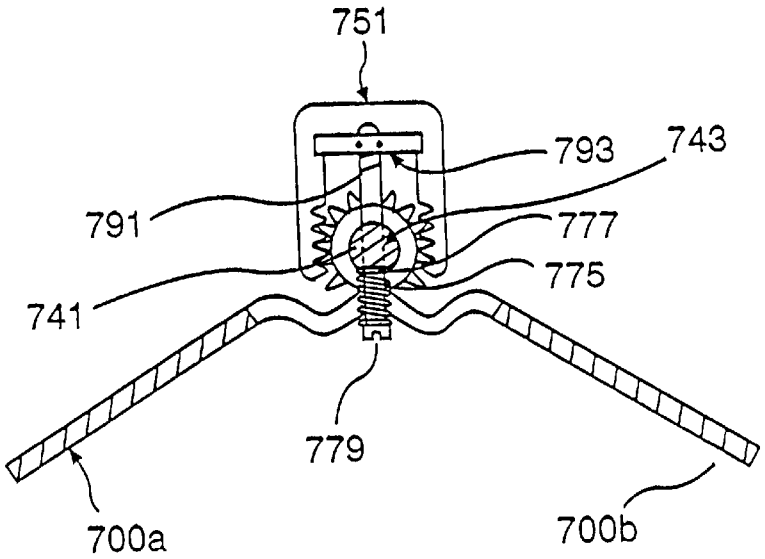
FIGS. 14 and 15 are cross-sectional end views of hinges with covers that are spring biased with respect to hinge pins.

As opposed to FIG. 14, FIG. 15 shows an embodiment of a self-closing hinge in which a resilient biasing member, spring 775, biases cover 751 towards pin 741. Cross guide 791 is threaded through mount plate 793 to bear against the cover 751 to clamp the cross guide 791 longitudinally thereto. The cross guide 791 is slideably received through transverse bore 743 in pin 741. Spring 775 is received around the cross guide 791 and is biased against an enlarged end 779 of the cross guide 791 and the plate 777, which abuts pin 741. Spring 775 thus biases the hinge towards a closed position.

Figure 16B:
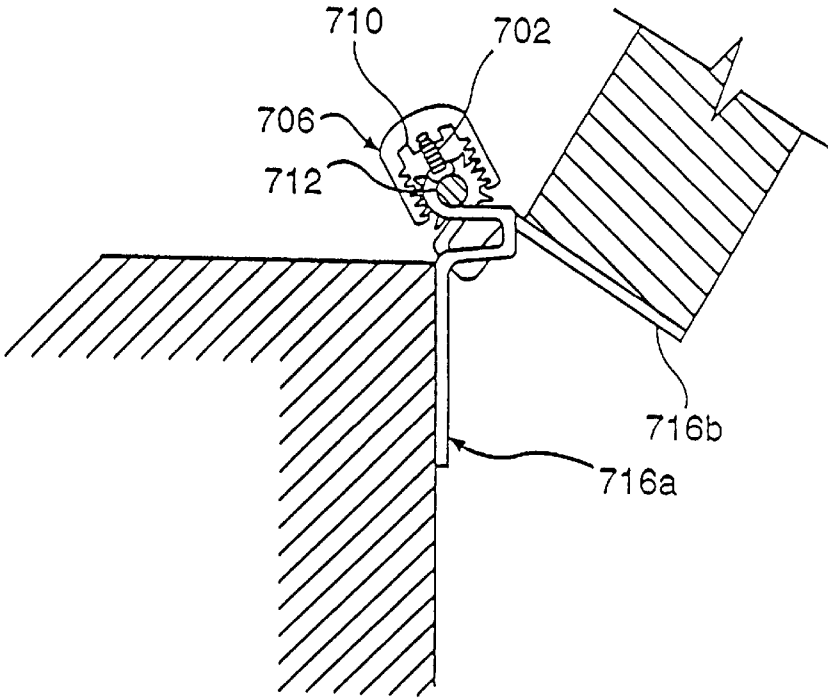
FIGS. 16A–B show the operation of another hinge with a spring disposed between a cover and the pin.
Figure 16A:
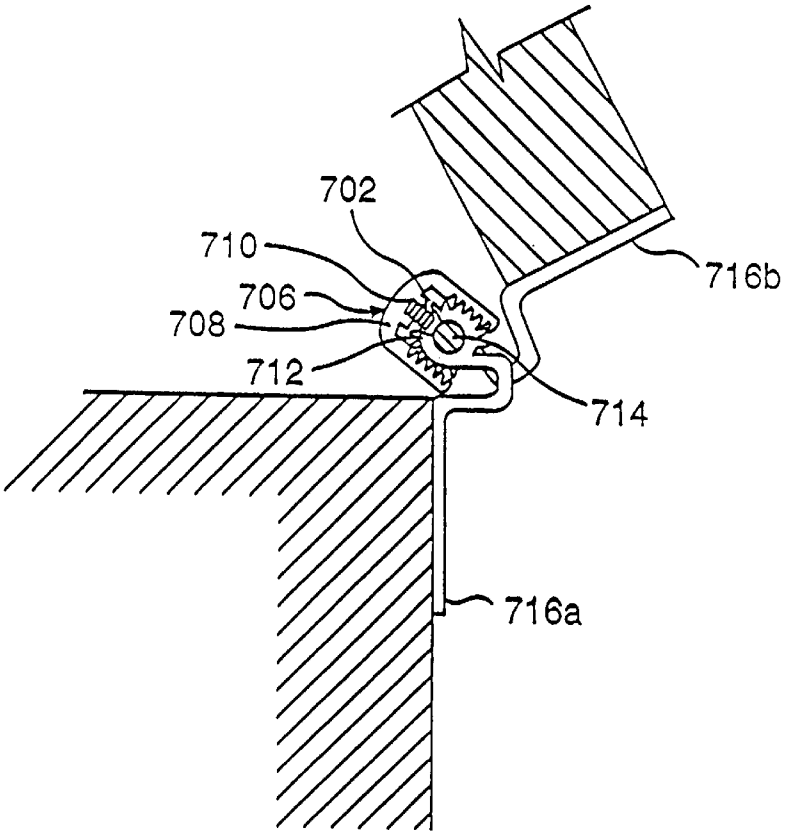

Referring to FIGS. 16A–B, a resilient member, spring 702, is compressed between pin 704 and cover 706. The cover base 708 forms a cover seat 710 with an elevated rim. A seat member 712 forms a seat on one side and a semicylindrical wall on the other. Ends of the spring 702 fit in the cover seat 710 and the seat of the seat member 712. The semicylindrical wall of the seat member 712, in Turn, is slideably biased against pin 714 by the spring 702. As a result of the bias separating the cover 708 from the pin 714, leaves 716 are biased towards a closed position because the leaves are pivotably mounted about the pin 714 and are operatively connected to the cover 706 in a manner similar to that in the FIGS. 6A–E embodiment.

Figure 17B:
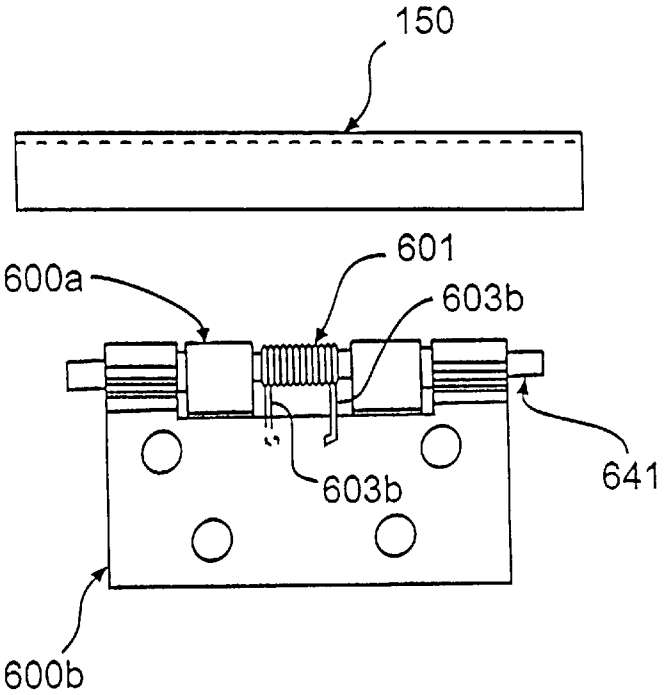
FIGS. 17A–B are a perspective and a side view of a hinge with a spring mounted around the pin.
Figure 17A:
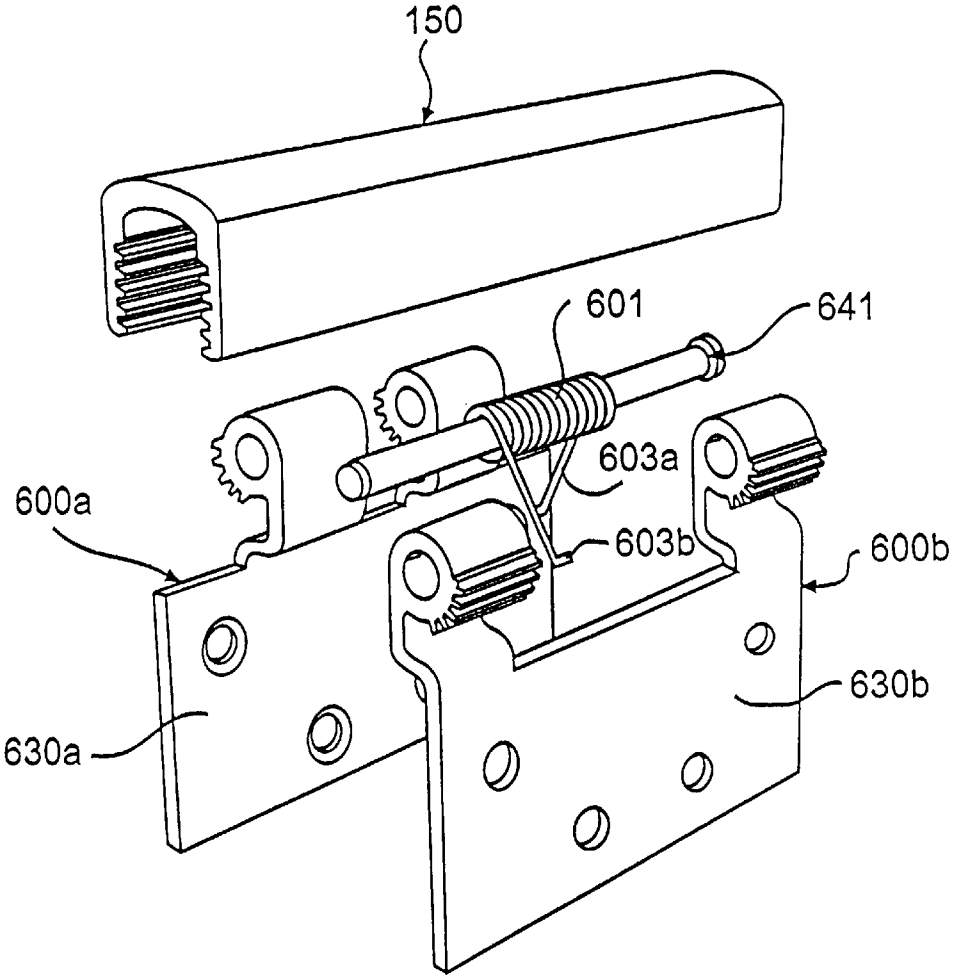

FIGS. 17A–B show another embodiment wherein a spring 601 is coiled around pin 641. Spring ends 603 bias leaf bodies 630 of leaves 600 towards each other, biasing the hinge towards a closed position. The cover 150, in this embodiment, hides from view the otherwise unattractive spring 601. This embodiment may be altered by placing the spring ends 603 between the leaves 600 to produce a self-opening hinge.

Figure 18:
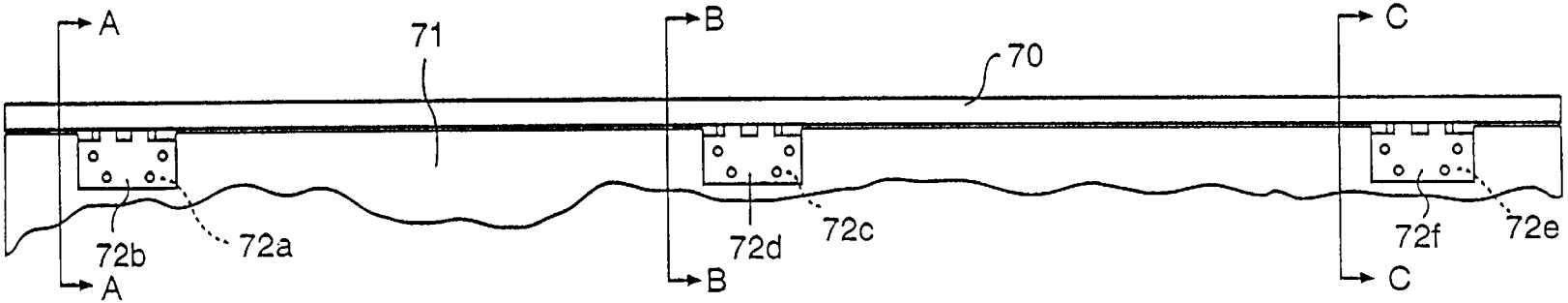
FIG. 18 is a side view of a closed hinge according to the invention.
Figure 18C:
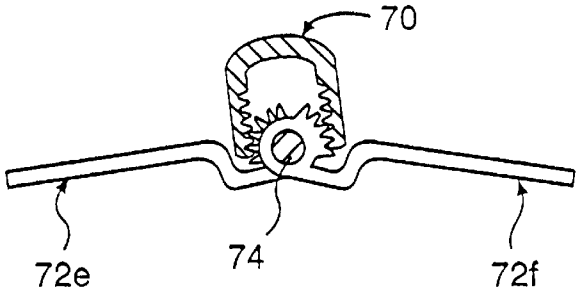
FIGS. 18A–C are cross-sectional end views taken through planes A—A, B—B, and C—C of FIG. 18, but with the hinge in a partially open position.
Figure 18B:
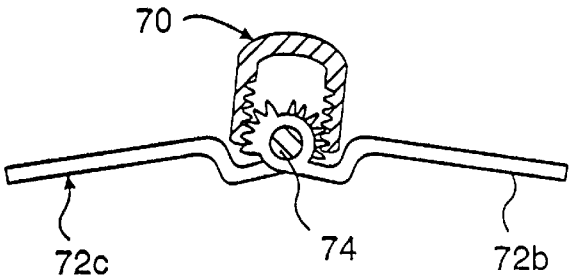
Figure 18A:
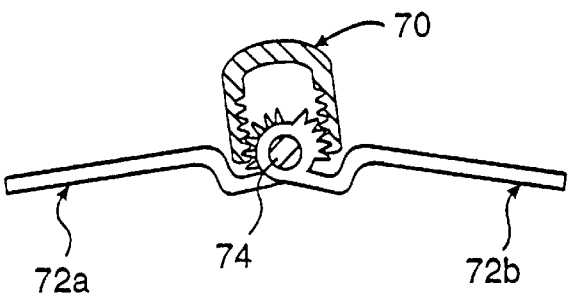

Referring to FIG. 18, the hinge shown has a cover 70 and three pairs of opposed leaves 72. Leaves 72*a,* 72*c,* and 72*e* are connected to a first structural member 71 and are thus coupled and pivotally fixed to each other, and leaves 72*b,* 72*d,* and 72*f* are connected to a second structural member (not shown) and are thus coupled and pivotally fixed to each other. The leaves 72 are operatively connected to the cover 70 such that leaves 72*a,* 72*b,* 72*e,* and 72*f* move the cover 70 towards the left in FIGS. 18A and 18C as the hinge is opened, whereas leaves 72*c* and 72*d* move the cover 70 to the right in FIG. 18B as the hinge is opened. As a result, the center of the cover 70 is twisted right with respect to pin 74, while the ends of the cover 70 are twisted left with respect to pin 74 as the hinge is opened. Thus twisted about its longitudinal axis, the cover 70 resiliently creates a bias towards its natural, straight configuration. This resiliency pivotally biases all of the leaves 72 towards a closed position.

Figure 19:
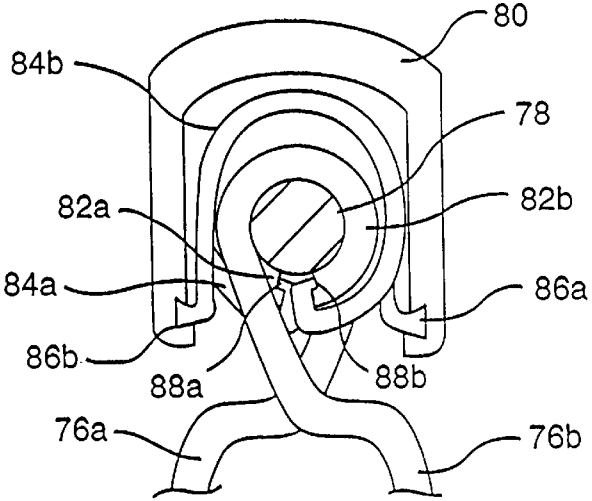
FIG. 19 and FIGS. 19A–D are cross-sectional end views of a hinge with leaf springs operatively connecting leaves to a cover.

FIG. 19 shows not only a self-opening hinge, but also an alternative way of operatively connecting hinge-leaves to a cover to move the cover in response to the pivoting position of the leaves. This hinge has two opposed leaves 76 that are pivotably mounted about a pin 78. A cover 80 surrounds leave knuckles 82. Leaf springs 84 have ends 86 anchored to the cover 80, and opposite ends 88 anchored to the knuckles 82.

Figure 19D:
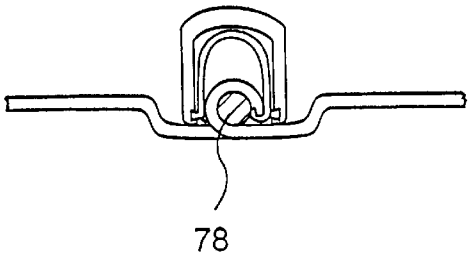
Figure 19C:
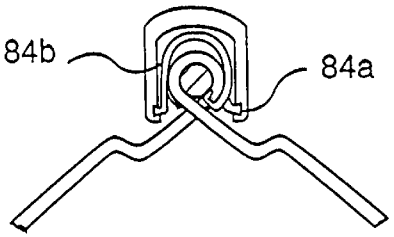
Figure 19B:
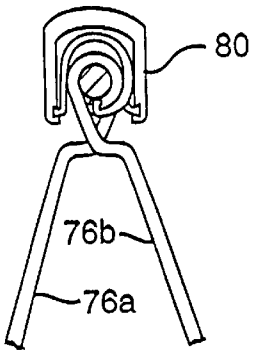
Figure 19A:
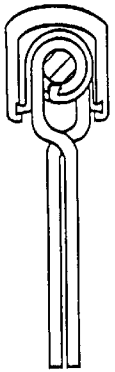

The leaf springs 84 are resiliently biased towards a configuration in which they are straight, although in other embodiments, they can be resiliently biased towards a configuration in which they are rolled up over themselves. FIGS. 19A–D show the hinge of FIG. 19 progressively as the leaf springs 84 bias the leaves 76 towards the open position of FIG. 19D. The leaf springs 84 are bent over a greater portion of their length in FIG. 19A than in the other figures. The leaf springs 84 thus naturally assume a straighter position as shown in FIG. 19D. As the leaf springs 84 bias the hinge towards an open position, their predictable unfolding moves the cover 80 along a predetermined locus with respect to the pin 78. Once the hinge is completely open, as shown in FIG. 19D, a limited additional pivoting of leaves 76 is permitted by additional determination of the leaf springs 84.

Figure 20A:
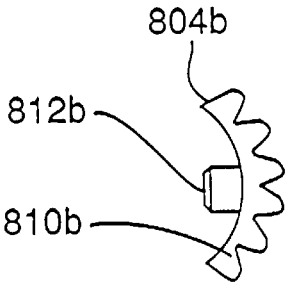
FIGS. 20A, 21A, and 22A are end views of the gear segments of FIGS. 20, 21, and 22, respectively.
Figure 20:
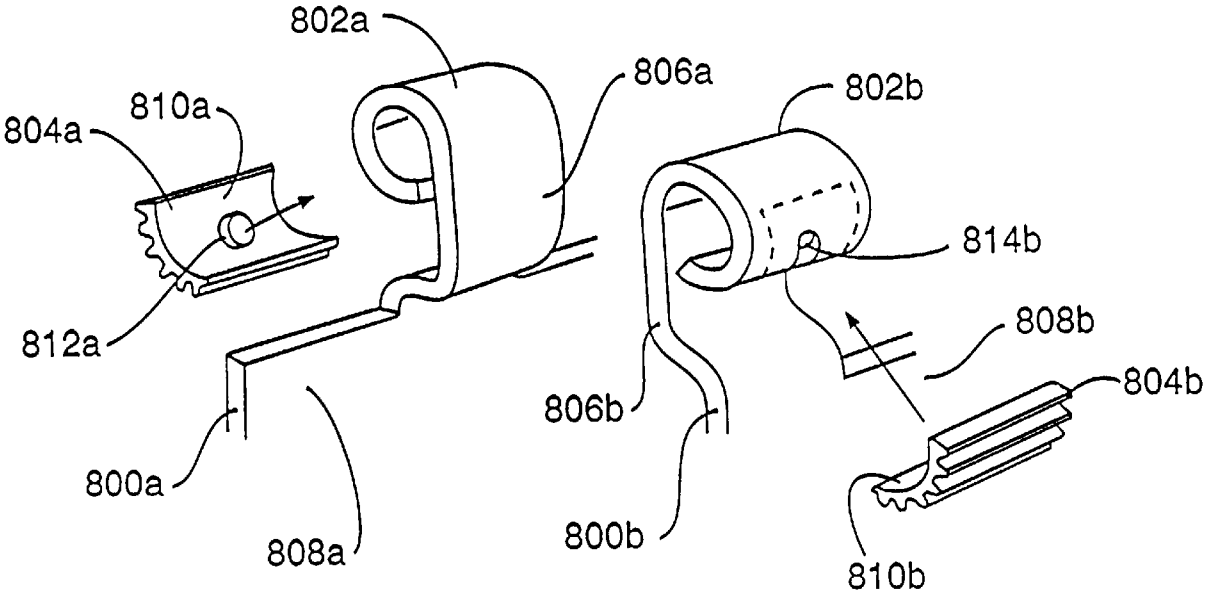
FIGS. 20, 21, and 22 are perspective, exploded views of hinges with attachable gear segments.

FIGS. 20 and 20A illustrate assembly of an alternative embodiment of an inventive hinge. Knuckles 802 of leaves 800 are formed separately from gear segments 804. The knuckles 802, shanks 806, and leaf bodies 808 are formed by shaping a single sheet of metal. The gear segments 804 have inner surfaces 810 that conform to the shape of the knuckles 802. The gear segments 804 also have tongues 812 that mate and couple with notches 814 formed in the knuckles 802, preferably in a snap-fit engagement. Thus joined, pivoting of the leaves 800 causes the gear segments 804 to pivot. Alternative manners of joining the gear segments to the knuckles exist, including adhering them together.

Figure 21A:
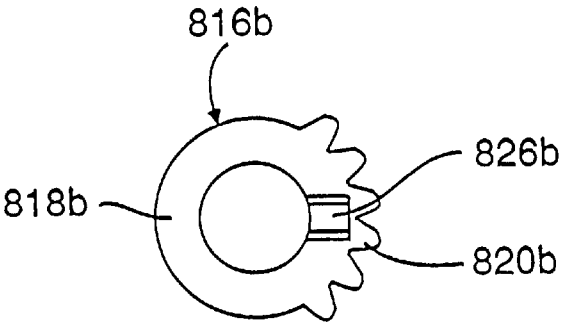
Figure 21:
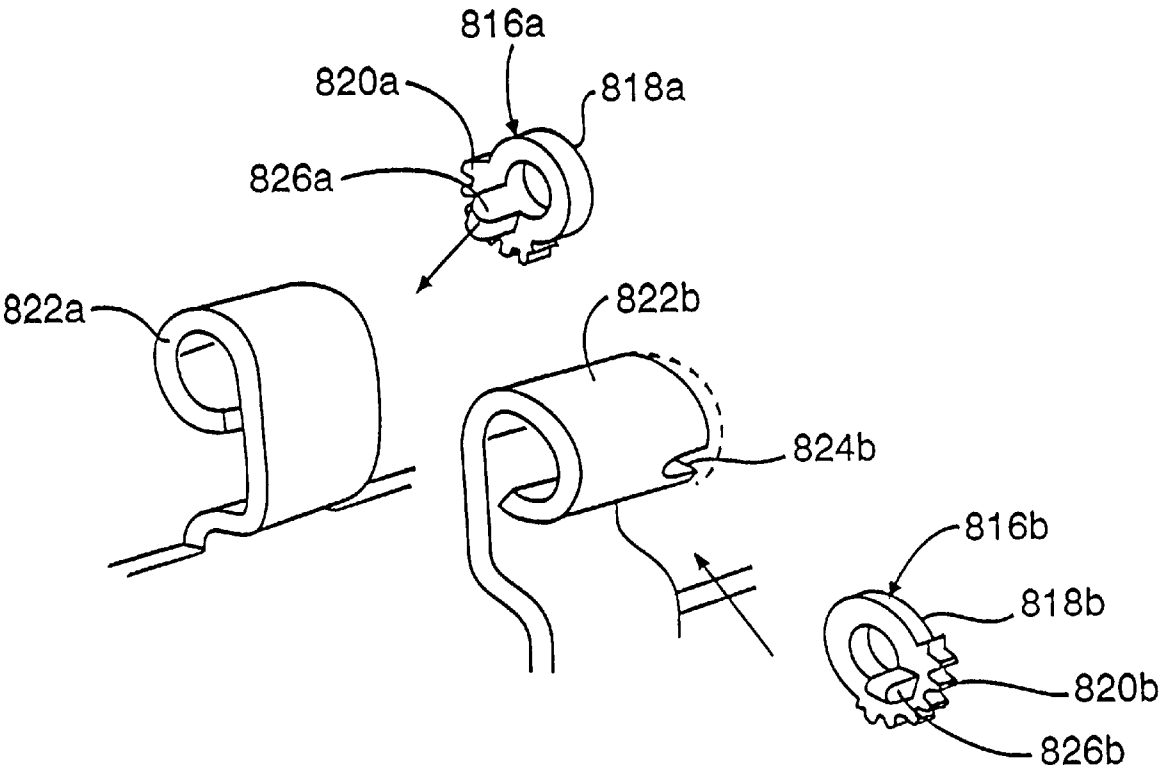

Referring to FIGS. 21 and 21A, gear segments 816 include a bearing portion 818 that functions as a bushing between adjacent knuckles 822. Gear teeth 820 of gear segments 816 extend from the bearing portion 816 in a common transverse plane. The knuckles 822 define notches 824 formed into their longitudinal ends. The gear segments 816 have tongues 826 configured to mate with notches 824 for coupling the gear segments 816 to the knuckles 822 in rotation.

Gear segments 816 are preferably made from hardened material to better withstand bearing and load forces imposed by adjacent knuckles 822. The bearing portions 818 may alternatively comprise a race for ball bearings or may otherwise support ball bearings mounted about the hinge pin.

Figure 22A:
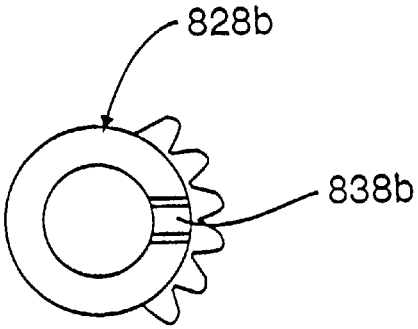
Figure 22:
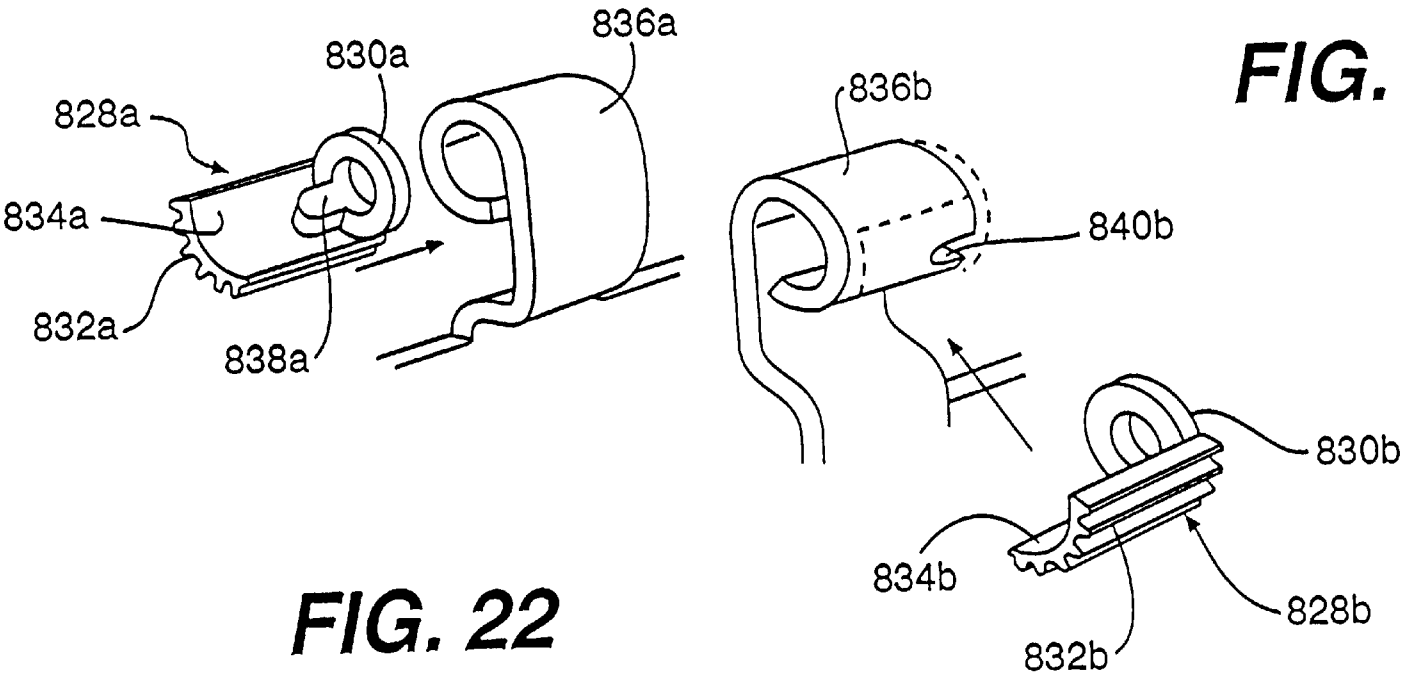

FIGS. 22 and 22A show an embodiment of hinge leaves that combines elements from the embodiments of FIGS. 20 and 21. Gear segments 828 include bearing portions 830, as well as wide geared-portions 832 overlying inner surfaces 834 that conform to the surface of knuckles 836. The gear segments 828 also have tongues 838 configured to mate with notches 840 in the longitudinal ends of the knuckles 836.

Various ways exist to assemble the hinges of the present invention. Referring to FIG. 1, in a first embodiment, the leaves 100 may first be joined together by inserting the pin 140 into the knuckle bores 124. The gear segments 122 and the cover racks 158 may be configured to disengage when the leaves 100 are opened by more than a preselected amount, such as 185°. The cover 150 may then be fit over the knuckles 120, and the leaves 100 may be closed, meshing the gear segments 122 with racks 158. This hinge may then be employed with a door that opens only up to less than the preselected amount.

Figure 23A:
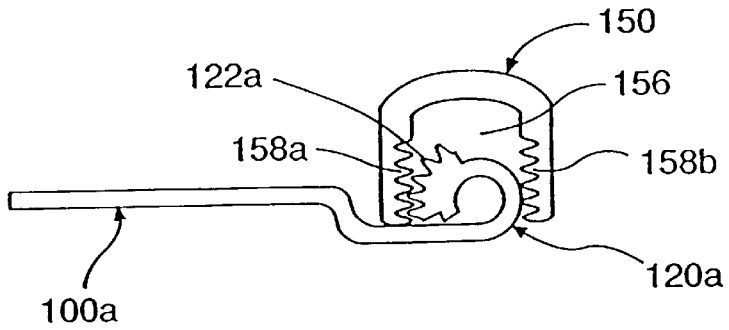
FIGS. 23A–D show a method for assembling a hinge according to the invention.
Figure 23B:
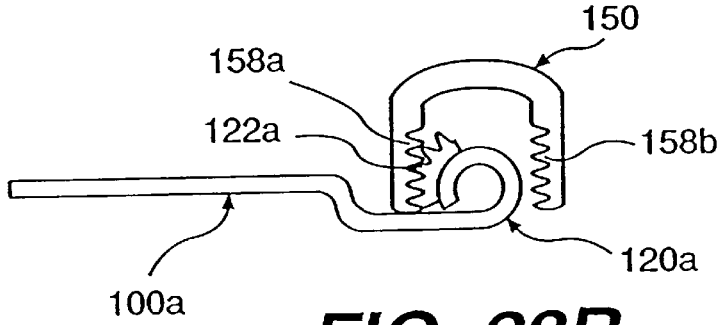
Figure 23C:
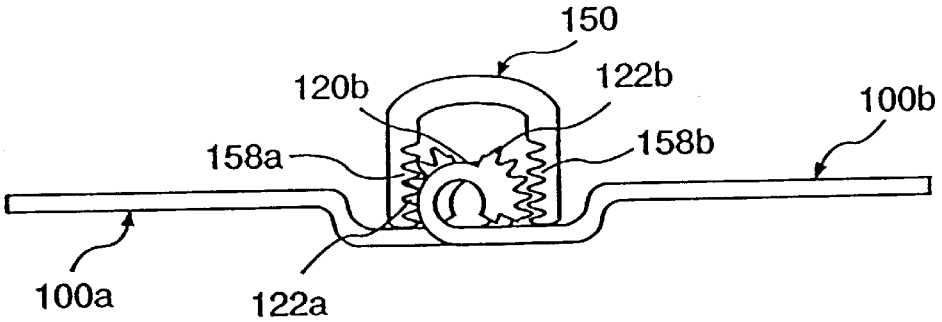
Figure 23D:
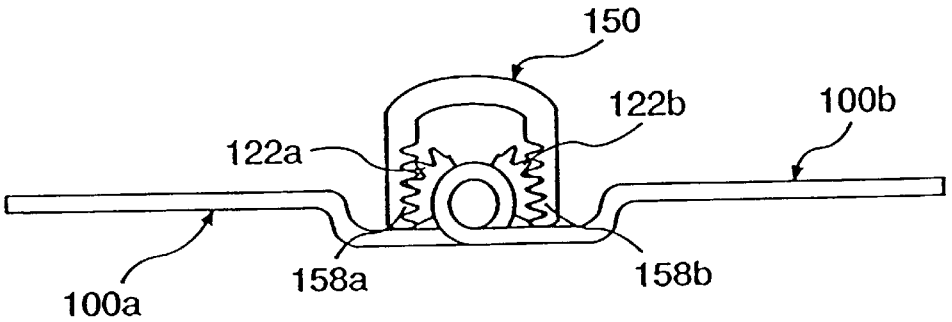

An alternative manner of assembling the hinge is illustrated in FIGS. 23A–D. Before the leaves 100 are joined with the pin 140, the knuckles 122*a* of a first of the leaves 100*a* are placed within the cover channel 156, as shown in FIG. 23A, and moved into mesh with rack 158*a,* as shown in FIG. 23B. The same process is repeated with leaf 100*b*, as shown in FIGS. 23C–D. Once the leaves 100 are properly seated in the cover channel 156, pin 140 is inserted. This hinge will not fall apart if the leaves 100 are spread as far as structurally possible.

Alternatively, the gear segments 122 of the leaves 100 can be slid longitudinally along the cover racks 158, up to their desired assembled position. At least one end cap 160 should be fitted to the cover 150 after insertion of the leaves 100.

FIGS. 24A–E illustrate various embodiments of geared covers suitable for use with geared leaves of the present invention. Cover 840 is formed from flexible sheet metal or plastic and has racks 842 formed separately therefrom and brazed or glued thereto. Cover 844 is formed from a flexible sheet corrugated to form racks 846. Cover 848 is similar to cover 844, but additionally includes an outside jacket 850 adhered to the base of the cover 848, for example made of plastic or wood, for improving aesthetics of the hinge or for increasing the rigidity of the base of the cover 848. Walls 854 of cover 852 comprise self-lubricating plastic rack-inserts 856 held in C-shaped metal clamps 858. The clamps 858 are welded to a flexible base 860. Cover 862 is made from a single, relatively stiff piece of metal, preferably aluminum or steel. The base of the cover 862 is reinforced with longitudinally extending ribs 864. Other cover embodiments can include a U-shaped insert within an outer cover.

In the covers of FIGS. 24A–D, at least part of each cover is flexible. This facilitates assembly as the walls of these covers can be spread as leaves, already joined with a pin, are inserted therein. Cover 862, of FIG. 24D, on the other hand, is better suited for a high-security door as it is much stiffer than its counterparts shown in FIGS. 24A–D.

Figure 25A:
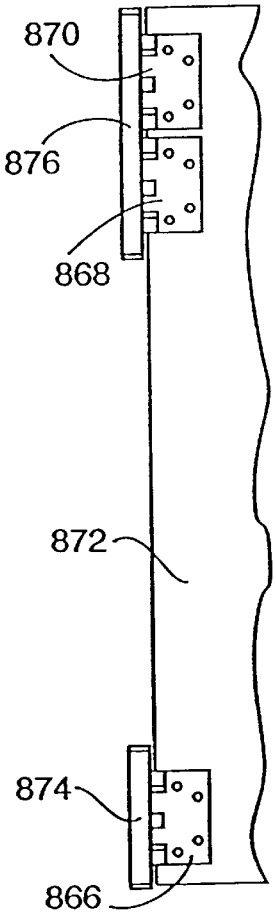
FIGS. 25A–C are side views of hinges according to the invention.
Figure 25B:
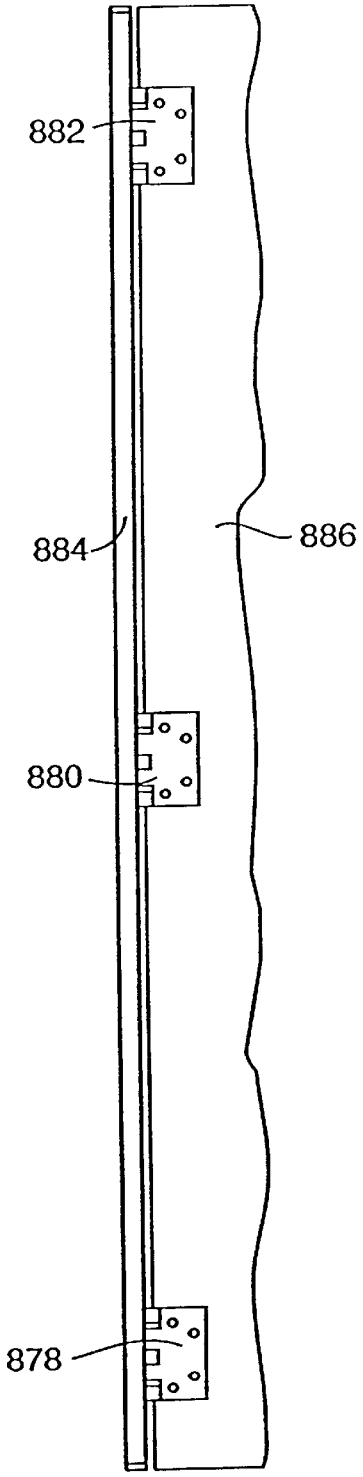
Figure 25C:
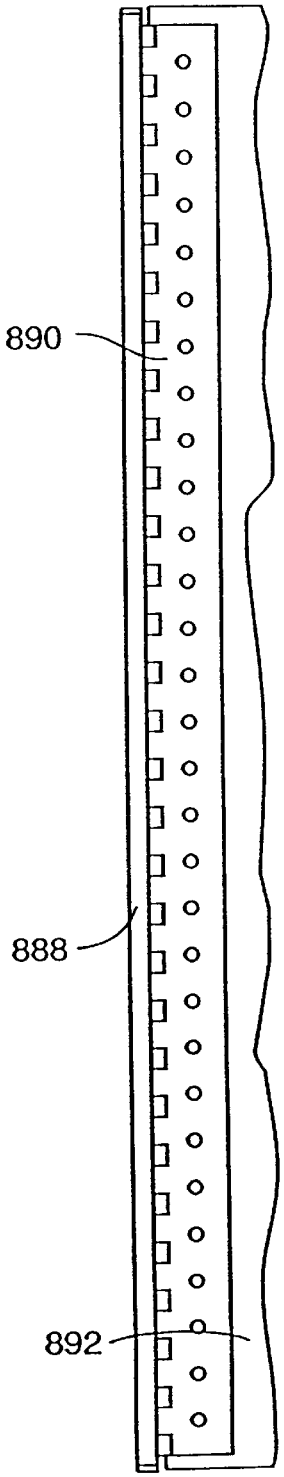

Finally, FIGS. 25A–C illustrate various arrangements for attaching hinges according to the invention to structural members. In FIG. 25A, leaf pairs 866, 868, and 870 are fixed to structural members 872, only one of which is shown. Leaf pair 866 has its own cover 874, while leaf pairs 868 and 870, disposed adjacent each other, are fitted with a single cover 876. In FIG. 25B, leaf pairs 878, 880, and 882 are all connected through a single cover 884, and are all affixed to structural members 886, one of which is shown. The embodiment of FIG. 24C is a piano hinge with a cover 888 and a single pair of leaves 890 fixed to structural members 892, only one of which is shown.

One of ordinary skill in the art can envision numerous variations and modifications. For example, each hinged member may be constructed integrally as a single piece including a leaf and a door. All of these modifications are contemplated by the true spirit and scope of the following claims.

What is claimed:

1. A pinned hinged combination comprising:

a first hinged member including a first leaf with a first knuckle;

a second hinged member including a second leaf with a second knuckle that defines a bore extending therethrough in a longitudinal direction;

a pin received within the bore of the second knuckle and associated with the first knuckles for pivotably joining and retaining the leaves; and a cover defining a longitudinal channel of a channel cross-section surrounding the knuckles for protecting the knuckles;

wherein the hinged members are pivotable between a closed position and an open position, the cover being operatively connected to the first and second leaves such that pivotal movement of the leaves displaces the cover substantially incrementally with respect to the pin substantially throughout the movement between the closed and open positions while substantially maintaining the channel cross-section.

2. The combination of claim 1, wherein the pin is fixed to the first knuckle.

3. The combination of claim 2, wherein the pin has a first end fixed to the first knuckle and a second end disposed on an opposite side of the second knuckle from the first knuckle, and further comprising an end piece fixed to the second end of the pin for retaining the leaves longitudinally together.

4. The combination of claim 1, wherein the leaves have a position in which the cover extends circumferentially around the pin by at least about 270° and the leaves are pivotable more than about 100°.

5. The combination of claim 1, wherein the knuckles have gear sectors and the cover has geared surfaces corresponding thereto, with the gear sectors and the geared surfaces being meshed such that pivotal movement of the leaves displaces the cover radially with respect to the pin.

6. The combination of claim 1, further comprising first and second leaf springs attached to the first and second knuckles respectively and also to the cover, the leaf springs being bent around the knuckles when the leaves are pivoted in one direction and straightening when the leaves are pivoted in an opposite direction for repositionably displacing the cover radially with respect to the pin in response to pivotal movement of the leaves.

7. The combination of claim 1, further comprising a biasing member associated with the cover and configured for pivotally biasing the leaves and causing relative movement between the pin and the cover.

8. The combination of claim 1, further comprising a cap associated with the cover for blocking a portion of the channel, wherein the first knuckle defines a bore extending therethrough in the longitudinal direction, and the pin is also received within the bore of the first knuckle.

9. The combination of claim 8, wherein the channel has an end and the cap is fitted to the cover at the end of the channel.

10. The combination of claim 8, wherein the cap is secured within the channel.

11. The combination of claim 8, wherein the cap has a lubricant port for feeding lubricant into the channel.

12. The combination of claim 1, wherein the first leaf has a plurality of said first knuckles and the second leaf has a plurality of said second knuckles, the first knuckles being interposed with the second knuckles.

13. The combination of claim 1, further comprising a cross guide attached to the cover and associated with the pin for guiding movement of the cover with respect to the pin.

14. The combination of claim 13, wherein the cross guide comprises a guide pin received transversely through the pin.

15. The combination of claim 13, wherein the cross guide comprises guide members disposed on opposite sides of the pin.

16. The combination of claim 13, wherein the cross guide retains the pin and the cover in a substantially fixed longitudinal position.

17. The combination of claim 1, wherein the hinged members include a wiper configured and dimensioned to wipe the cover as the hinged combination pivots.

18. The combination of claim 1, further comprising a spring mounted to the pin for pivotably biasing the hinged members, wherein the cover is configured and dimensioned for concealing the spring.

19. The combination of claim 1, further comprising a biasing member associated with the cover and configured for biasing the pin and knuckles towards or away from the cover.

20. The combination of claim 19, wherein the biasing member comprises a resiliently deformable structure.

21. The combination of claim 19, wherein the biasing member has ends attached to the cover and the leaves.

22. A pinned hinged combination, comprising:

a first hinged member including a first leaf with a first knuckle;

a second hinged member including a second leaf with a second knuckle that defines a bore extending therethrough in a longitudinal direction;

a pin received within the bore of the second knuckle and associated with the first knuckles for pivotably joining and retaining the leaves;

a cover defining a longitudinal channel surrounding the knuckles for protecting the knuckles; and a seal disposed for sealing the cover to the hinged members when the hinged combination is in a predetermined pivotal position.

23. The combination of claim 22, wherein the hinged combination is in the predetermined position when the hinged combination is closed.

24. The combination of claim 22, wherein the cover and the leaves are operatively connected for moving the cover such that it compresses the seal when the hinged combination is in said predetermined position and releases the seal when the hinged combination is pivoted to another predetermined position.

25. The combination of claim 24, wherein the cover channel has an open side receiving the leaves, the seal being disposed between the cover and the hinged members on a side of the cover opposite the open side of the channel when the hinged combination is closed.

26. A pinned hinged combination, comprising:

a first hinged member including a first leaf with a first knuckle;

a second hinged member including a second leaf with a second knuckle that defines a bore extending therethrough in a longitudinal direction;

a pin received within the bore of the second knuckle and associated with the first knuckles for pivotably joining and retaining the leaves; and a cover defining a longitudinal channel surrounding the knuckles for protecting the knuckles;

wherein at least one of the hinged members includes an extension that extends over the cover, the extension and the cover being configured for selectively opening and closing an electrical circuit when the cover and the extension abut and separate.

27. A pinned hinged combination, comprising:

a first hinged member including a first leaf with a first knuckle, the first leaf comprising a first body and a first shank having ends joining the first body to the first knuckle;

a second hinged member including a second leaf with a second knuckle that defines a bore extending therethrough in a longitudinal direction, the second leaf comprises a second body and a second shank having ends joining the second body to the second knuckle;

a pin received within the bore of the second knuckle and associated with the first knuckles for pivotably joining and retaining the leaves; and a cover defining a longitudinal channel surrounding the knuckles for protecting the knuckles;

wherein the shanks are configured such that the leaves are pivotable to a first position in which the first shank overlaps the second shank along the longitudinal direction.

28. The combination of claim 27, wherein the ends of the shank of one of the leaves in the first position are disposed on opposite sides of the other leaf.

29. The combination of claim 27, wherein at least one of the shanks has at least a double bend.

30. A pinned hinged combination comprising:

a first hinged member including a first leaf with a first knuckle;

a second hinged member including a second leaf with a second knuckle that defines a bore extending therethrough in a longitudinal direction;

first and second gear segments associated with the first and second knuckles respectively;

a pin received within the bore of the second knuckle and associated with the first knuckles for pivotably joining and retaining the leaves; and a cover defining a longitudinal channel surrounding the knuckles for protecting them, the cover having first and second geared surfaces within the channel meshed with the first and second gear segments respectively such that pivotal movement of the leaves displaces the cover radially with respect to the pin.

31. The combination of claim 30, wherein the leaves are configured and dimensioned such that opening pivotal movement of the leaves displaces the cover away from the pin, the first knuckle defines a bore extending therethrough in the longitudinal direction, and the pin is also received within the bore of the first knuckle.

32. The combination of claim 31, wherein one of the knuckle and gear segment of one of the leaves defines a notch and the other of the knuckle and gear segment defines a tongue that is matable with the notch such that pivoting of said one of the leaves causes the gear segment of said one of the leaves to pivot therewith.

33. The combination of claim 32, wherein the knuckle of said one of the leaves defines the notch and the gear segment of said one of the leaves defines the tongue.

34. The combination of claim 33, wherein one of the gear segments has a bearing attached thereto for placement between adjacent knuckles.

35. The combination of claim 30, wherein the leaves are configured and dimensioned such that opening pivotal movement of the leaves displaces the cover towards the pin.

36. The combination of claim 35, wherein at least one of the leaves comprises a body and a shank joining the body to the knuckle of the at least one of the leaves, the shank having a U-shaped portion for fitting around the cover when the hinged combination is open.

37. The combination of claim 36, wherein the shank has at least a triple bend defining the U-shaped portion.

38. The combination of claim 30, wherein the first gear segment has a first gear radius, and the second gear segment has a second gear radius that is a different size than the first gear radius such that the cover travels along a curved locus with respect to the pin when the leaves are pivoted.

39. The combination of claim 30, wherein the knuckle and gear segment of at least one of the leaves are of integral construction.

40. A pinned hinged combination, comprising:

a first hinged member including a first leaf with a first knuckle;

a second hinged member including a second leaf with a second knuckle defining a bore extending therethrough in a longitudinal direction;

a pin received within the bore and associated with the first knuckle for pivotably joining and retaining the leaves;

a cover defining a longitudinal channel surrounding the knuckles for protecting them, the cover having first and second portions connected to the hinged members at first and second longitudinally spaced locations, respectively; and wherein the first and second knuckles are operatively connected to the first portion of the cover at the first location such that pivoting of the leaves resiliently twists the first portion of the cover with respect to the second portion for pivotally biasing the leaves.

41. The combination of claim 40, comprising:

a third knuckle coupled with the first leaf; and a fourth knuckle coupled with the second leaf;

wherein the first and second knuckles are operatively connected to the first portion of the cover at the first location such that pivoting of the leaves moves the first portion of the cover along a locus extending in a first direction with respect to the pin, the third and fourth knuckles being operatively connected to the second portion of the cover at the second location such that the pivoting of the leaves moves the second portion of the cover along another locus extending in a second direction with respect to the pin for causing the twisting of the cover.

42. The combination of claim 41, wherein each of the first, third, and fourth knuckles define a bore extending therethrough in the longitudinal direction, the first and second knuckles being pivotably pinned together through their respective bores and the third and fourth knuckles being pivotably pinned together through their respective bores.

* * * * *